US005997458A

United States Patent [19]

Guttinger et al.

[11] Patent Number: 5,997,458

[45] Date of Patent: Dec. 7, 1999

[54] ROTARY OBJECT FEEDER

[75] Inventors: Peter Guttinger, Milton; Tony Spadafora, Ancaster; Michael Elent, Vaughan, all of Canada

[73] Assignee: Langen Packaging Inc., Ontario, Canada

[21] Appl. No.: 08/828,589

[22] Filed: Mar. 31, 1997

Related U.S. Application Data

[63] Continuation-in-part of application No. 08/535,945, Sep. 28, 1995, abandoned.

[51] Int. Cl.[6] ..... B65H 3/08; B31B 1/80

[52] U.S. Cl. ..... 493/315; 271/95; 271/108

[58] Field of Search ..... 271/91–96, 108; 493/315, 316, 317, 318; 414/736, 737

[56] References Cited

U.S. PATENT DOCUMENTS

| | | | |
|---|---|---|---|
| 3,026,989 | 3/1962 | Schaltegger | 198/25 |
| 3,882,998 | 5/1975 | Hunter | 198/287 |
| 4,194,442 | 3/1980 | Martelli | 93/53 |
| 4,391,372 | 7/1983 | Calhoun | 209/523 |
| 4,425,075 | 1/1984 | Quinn | 414/755 |
| 4,514,181 | 4/1985 | Hughes | 493/131 |
| 4,518,301 | 5/1985 | Greenwell | 414/129 |
| 4,530,686 | 7/1985 | Everson et al. | 493/315 |
| 4,537,587 | 8/1985 | Langen | 493/315 |
| 4,582,315 | 4/1986 | Scarpa et al. | 271/150 |
| 4,596,545 | 6/1986 | Greenwell | 493/315 |
| 4,601,691 | 7/1986 | Greenwell | 493/313 |
| 4,625,575 | 12/1986 | Le Bras | 74/63 |
| 4,643,633 | 2/1987 | Lashyro | 414/732 |
| 4,773,525 | 9/1988 | Gertitschke et al. | 198/471.1 |
| 4,830,172 | 5/1989 | Hilton et al. | 198/392 |
| 4,869,486 | 9/1989 | Scarpa et al. | 271/3.1 |
| 4,871,348 | 10/1989 | Konaka | 493/315 |
| 4,874,076 | 10/1989 | Kaplan et al. | 198/370 |
| 4,901,843 | 2/1990 | Lashyro | 198/418.3 |
| 4,902,192 | 2/1990 | Ziegler | 414/732 |
| 4,934,682 | 6/1990 | Rece et al. | 271/3.1 |
| 4,998,910 | 3/1991 | Mohaupt et al. | 493/12 |
| 5,023,974 | 6/1991 | Coles | 452/177 |
| 5,028,044 | 7/1991 | Fischer | 271/91 |
| 5,037,018 | 8/1991 | Matsuda et al. | 222/650 |
| 5,176,612 | 1/1993 | Calvert et al. | 493/315 |
| 5,183,145 | 2/1993 | Williams et al. | 198/441 |
| 5,188,411 | 2/1993 | Golden | 294/64.2 |
| 5,201,560 | 4/1993 | Golden | 294/64.2 |
| 5,215,515 | 6/1993 | Bershadsky | 493/315 |
| 5,234,304 | 8/1993 | Okumoto et al. | 414/225 |
| 5,234,314 | 8/1993 | Ganz | 414/797.8 |
| 5,249,916 | 10/1993 | Portrait et al. | 414/798.9 |
| 5,254,071 | 10/1993 | Laroche | 493/96 |

(List continued on next page.)

FOREIGN PATENT DOCUMENTS

| | | |
|---|---|---|
| 1204798 | 5/1986 | Canada . |
| 1225109 | 8/1987 | Canada . |
| 2066837 | 10/1992 | Canada . |
| 1330219 | 6/1994 | Canada . |
| 0132617 | 2/1985 | European Pat. Off. . |
| 0134628 | 3/1985 | European Pat. Off. . |
| 0148345 | 7/1985 | European Pat. Off. . |
| 0580958 | 2/1994 | European Pat. Off. . |
| 2487310 | 1/1982 | France . |
| 2192602 | 1/1988 | United Kingdom . |

*Primary Examiner*—Jack W. Lavinder

[57] ABSTRACT

The present invention is directed to a rotary object feeder, which feeds objects from a by rotating the objects from a pick-up location to a drop-off location. The object is picked-up by at least one pick-up member having a suction cup. Suction at the suction cup is controlled by a vacuum generator proximate the suction cup. Additionally, a control valve is interconnected to a programmable controller that controls the presence or absence of suction at the suction cup. The controller may be dynamically programmed for flexibly adjusting the pick-up and drop-off locations for objects. The controller may further advance the turn-off position of vacuum at the suction cup, in order to implement a speed compensation system to accurately deliver objects to the drop-off location. The invention is particular well suited for use as a rotary carton feeder.

31 Claims, 16 Drawing Sheets

U.S. PATENT DOCUMENTS 5,371,995 12/1994 Guttinger et al. ..... 53/251
5,411,464 5/1995 Calvert et al. ..... 493/315
5,413,210 5/1995 Turnet et al. ..... 198/642
5,421,447 6/1995 Ruth et al. ..... 198/377
5,431,274 7/1995 Schaupp ..... 198/474.1
5,456,570 10/1995 Davis et al. ..... 414/742
5,603,599 2/1997 Wesslen ..... 414/411

130b
18
140b
131b
142b
52
5
38
82
120b
37
124
39
36
50
30
119b
126
22a
80a
6
58a
142b
16
140b
D/2
108a
70a
112a
33a
84a
118a
56a
44a
62a
5
116a
32a
117a
121a
72a
53a
48a
e
114a
112a
46a
84a 34a
106a
122a
80a
60a
74a
114a
3
6

ROTARY OBJECT FEEDER

CROSS-REFERENCE TO RELATED APPLICATIONS

This is a continuation-in-part application of U.S. patent application Ser. No. 08/535,945, filed Sep. 28, 1995, now abandoned.

FIELD OF THE INVENTION

The present invention is directed to an object feeder, more particularly to a rotary object feeder that feed an object by rotating the object about at least one axis of rotation and preferably, about three parallel, axes of rotation.

BACKGROUND OF THE INVENTION

Numerous rotary object feeders are known. For example, U.S. Pat. No. 4,518,301 issued May 21, 1985 to R.A. Jones & Co. Inc., discloses an orbital feeder suited for picking up folded cartons from a storage magazine and transporting them to a conveyor, where they are released.

The difficulties with rotary feeders are numerous. The objects to be picked up, such as folded cartons in a magazine, are stationary. It is therefore not possible to simply wipe past the cartons with a pick-up member, typically a suction cup, rotating past the object, with any degree of reliability. Accordingly, a solution to overcome this problem is to alter the path of the pick-up members so that they make contact with the object as they are travelling in a direction generally perpendicular to the plane of the cartons. Rotary carton feeders implementing this solution are known, and incorporate suction cups used as pick-up members mounted on planetary elements. The suction cups move along a hypocycloidal path, and will pick-up objects at points along their path where the suction-cups are travelling in a direction which is perpendicular to the objects. However, because the additional rotation of a planetary element, the perpendicular movement may be somewhat abrupt. Additionally, the object to be picked up is rotated about an additional axis, which may significantly increase the net velocity of the object at certain points along its path. Accordingly, object feeders using this solution do not lend themselves to operation at high speeds. Furthermore to achieve the desired movement, the object is rotated inwardly toward a central axis. This restricts the size and number of objects that can be handled simultaneously by the object feeder.

Moreover, conventional rotary feeders generally use pick-up members that are mechanically linked to the rotation of the feeder. Camming mechanisms, in combination with mechanical air valves, for example, may be used to provide air to suction cups of a feeder, as the feeder rotates. These mechanical arrangements are quite inflexible. They do not allow for the dynamic adjustment of pick-up and drop-off locations around the periphery of the feeder. Moreover, they do not allow adjustment of the release of picked-up objects in response to operating conditions, such as the speed of rotation of the carrier.

SUMMARY OF THE INVENTION

It is an object of the present invention to provide a rotary object feeder capable of operating at increased speeds and potentially having increased flexibility in picking-up and releasing objects fed by such a feeder.

In accordance with an aspect of the present invention, there is provided a rotary object feeder comprising: a support; a carrier member rotatably mounted to said support for rotation about a sun axis of rotation; an object pick-up member mounted to said carrier member for rotation therewith; said object pick-up member comprising a suction cup, having an outer surface for picking-up and releasing objects proximate a periphery of said feeder; a vacuum generator having an inlet and an outlet for generating a source of vacuum at said outlet from a source pressurized air at said inlet; said vacuum generator inlet in flow communication with a source of pressurized air; said vacuum generator outlet in flow communication with said suction cup.

In accordance with another aspect of the present invention, there is provided a rotary object feeder comprising: a support; a carrier member rotatably mounted to said support for rotation about a sun axis of rotation; an object pick-up member comprising a suction cup, having an outer surface for picking-up and releasing objects proximate a periphery of said feeder, mounted to said carrier member, for rotation therewith; an electrically controlled air control valve in flow communication with a source of pressurized air and said suction cup to provide suction at said outer surface; a controller, in communication with said control valve, to open and close said control valve to provide suction at said outer surface; a position sensor on said feeder, in communication with said controller to provide a signal indicative of an angular position of said carrier member about said sun axis wherein said controller is adapted to provide suction at said surface in response to sensed, pre-programmed angular positions of said carrier member.

In accordance with yet another aspect of the present invention, there is provided a method of feeding an object from a pick-up location to a drop-off location, on the periphery of a rotary object feeder. The rotary object feeder comprises: a support; a carrier member rotatably mounted to said support for rotation about a sun axis of rotation; an object pick-up member mounted to said support, for rotation therewith; said object pick-up member comprising a suction cup, having an outer surface that passes proximate said pick-up and drop-off location as said carrier member is rotated about said sun axis, said suction cup for picking-up and releasing objects proximate said pick-up and drop-off locations. The method comprises the steps of: a. continuously rotating said carrier member and said pick-up member about said sun axis; b. continuously sensing an angular position of said carrier and said pick-up member relative to said support; c. continuously determining the angular rate of rotation of said carrier; d. applying a vacuum at said suction cup before said suction cup reaches proximate said pick-up location to pick up an object at said pick-up location; e. determining a vacuum turn-off point, in advance of said drop off location, based on said angular rate-of rotation, said turn-off point calculated so that said picked-up object, retained by said vacuum at said suction cup is released at said drop-off location in response to turning-off said vacuum at said vacuum turn-off point; f. turning off said vacuum at said suction cup as said suction cup reaches said turn-off point.

Preferably, a rotary object feeder in accordance with this invention, feeds objects from a first location to a second location by rotating the object about three axes. Such an object feeder feeds the object from a pick-up location to an off-loading location, by moving an object pick-up member along a trajectory formed by rotating the object pick-up member about a first axis of rotation; rotating this first axis of rotation about a second axis of rotation substantially parallel to the first axis of rotation and spaced therefrom; rotating the second axis of rotation about a third axis of rotation substantially parallel to the second axis of rotation and spaced therefrom. The first, second and third axes of rotation may be analogized to moon, planet and sun axes in a solar system.

The resulting trajectory of the object about a third axis is hypocycloidal. The object passes at least one point at which the object is at a farthest distance from this third axis. This farthest location is reached when the object, the first axis, the second axis and the third axis of rotation are collinear. This location can be considered a vertex of the object's trajectory. At this point, the object will change its radial direction away from the first axis toward the second axis. The number of vertices along the object's trajectory as the object rotates about the third axis will vary deeding on the relative rates of rotation of the first axis about the second axis and the second axis about the third axis.

For example, if the first axis is rotated more quickly about the second axis than the second axis is rotated about the third axis, the object's trajectory will have at least one vertex for each rotation of the object about the third axis. Similarly, if the first axis rotates about the second axis at a rate of rotation slower than that of the second axis about the third axis, the object will only reach a vertex of its trajectory after the second axis has rotated about the third axis at least once.

Additionally, the choice of distances from the first axis to the second axis; from the second axis to the third axis; and from the third axis to the object combined with the relative rates of rotation of the object about its three axes may be chosen to minimize the tangential velocity of the object in its orbit about the third axis at these vertices.

Ideally, the rate of rotation of the second axis about the third axis (angular velocity $\omega_1$), and the rate of rotation of the first axis about the second axis (angular velocity $\omega_2$)will be chosen as integer multiples of each other, with $\omega_2>\omega_1$. Thereby the trajectory of the object will have $\omega_2/\omega_1$ vertices for each rotation of the second axis about the third axis. The location of these vertices relative to some fixed point, (for example, the location of the third axis) may be arbitrarily selected and will remain the same for each rotation of the second axis about the third axis.

The use of three axes of rotation may further permit the object as it rotates about the third axis to face generally outward from the third axis at all times. Thus when the invention is embodied in a rotary object feeder, relatively large objects may be picked-up and transported on a rotary carrier. The objects remain generally on the periphery of the carrier without being rotated toward its centre. Additionally, the path taken by the object may be made smoother and its velocity may be minimized the object is rotated about the third axis at an angular velocity equal in magnitude but opposite in direction to the magnitude and direction of the angular velocity of the first axis about the second axis. As a result, rotary object feeders in accordance with this invention lend themselves to use at very high speeds.

A rotary object feeder in accordance with this invention need not be limited to a single pick-up member rotatably mounted about three axes. An object feeder in accordance with this invention may have any number of pick-up members, each having arbitrary rates of rotation about a first, second and third axis. In this way, the invention may extend to a rotary canton feeder, in which the pick-up members may be analogized to moons in a solar system having numerous planets.

As the preferred embodiments detailed herein reveal, this invention is particularly well suited for use with a rotary carton feeder which will have enhanced advantages when numerous planetary members are mounted about a third axis such that the pick-up members reach vertices along their trajectories at equidistant points from the third axis. Moreover, if numerous pick-up members rotate about a third axis, it will be advantageous if a number of these pick-up members travel along identical trajectories so that they reach the vertices of their paths at the same locations. The vertices may then be used as pick-up, operating and drop-off locations for an object.

The preferred embodiments described herein are directed to

Embodiment 1—a rotary carton feeder having three pick-up members. travelling along an identical trajectory having three vertices along its path;

Embodiment 2—a rotary carton feeder having six pick-up members, each pick-up member travelling along a trajectory having three vertices, three of the pick-up members travelling along one trajectory, three other pick-up members travelling along a different trajectory;

Embodiment 3—a rotary carton feeder having six pick-up members, each pick-up member travelling along an identical trajectory having three vertices; and Embodiment 4—a rotary carton feeder having six pick-up members, each pick-up member travelling along an identical trajectory having six vertices.

BRIEF DESCRIPTION OF THE DRAWINGS

In the drawings which illustrate preferred embodiments of the present invention.

DETAILED DESCRIPTION OF THE PREFERRED EMBODIMENTS

Embodiment 1

Figure 1:
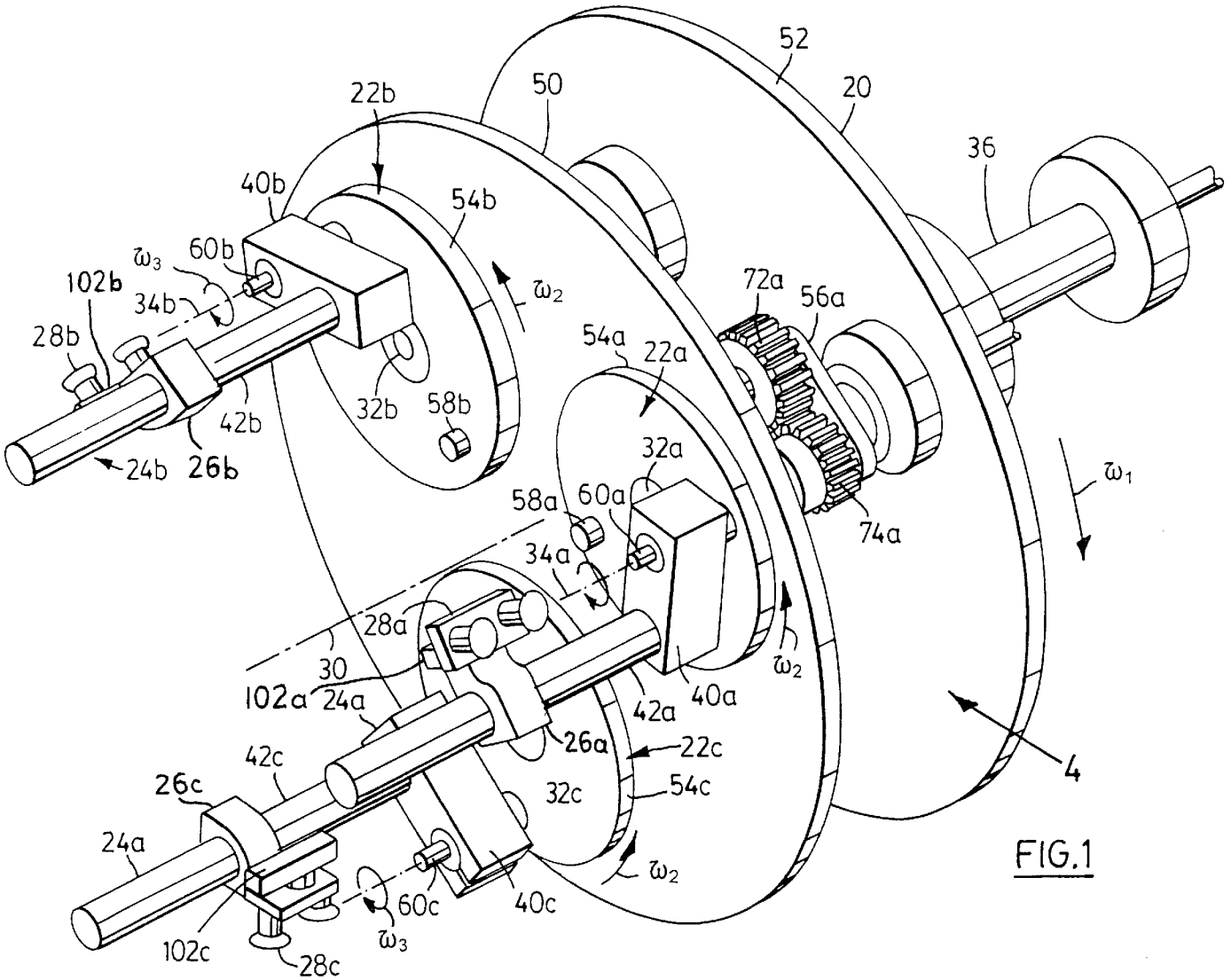
FIG. 1 is a perspective view of an object feeder having 3 pick-up heads, in accordance with one aspect of the present invention.

With reference to FIGS. 1–6, there is provided a rotary object feeder generally designated 18 having three identical planetary assemblies 22*a*, 22*b* and 22*c*.

As shown in FIGS. 1, 3, 4, 5 and 6, there is provided a rotary object feeder 18 having a carrier member 20. Carrier member 20 is comprised of two circular disks 50 and 52. Disks 50 and 52 are made of a durable, rigid material such as steel or aluminum. A main shaft 36 is fixedly mounted to disk 52. Main shaft 36 is coaxial with a sun axis 30. A sun gear 38 is fixedly mounted on a support frame 16, adjacent to the rear side of disk 52 farthest from disk 50. Sun gear 38 is mounted on main shaft 36 and has a centre axis coincident with sun axis 30. Shaft 36 is rotatable relative to fixed sun gear 38.

Three identical planetary members 22*a*, 22*b* and 22*c* are mounted on carrier member 20. The three planetary members 22*a*, 22*b* and 22*c* are mounted about planetary axes 32*a*, 32*b* and 32*c* at equal distances from sun axis 30, and at equal distances from each other. Only one planetary member 22*a* will be described herein in detail but it will be understood that planetary members 22*b* and 22*c* are identical in structure.

Planetary member 22*a* is rotatably mounted on carrier member 20 about a planetary axis 32*a*. Planetary axis 32*a* is oriented parallel to sun axis 30. Planetary member 22*a* is comprised of circular disk 54*a* and a lever 56*a*. Circular disk 54*a* and lever 56*a* are made of a material similar to that of circular disks 50 and 52. Circular disk 50 has a circular cut-out for seating planetary member 22*a* and particularly disk 54*a*. Disk 54*a* may be mounted with its outer surface flush with the outer surface of disk 50. Bearings 80*a* are interposed between disk 50 and disk 54*a*.

An idler gear 44*a* is rotatably mounted on disk 52 about shaft 33*a* so that it is freely rotatable about shaft 33*a* relative to disk 52 on the side of disk 52 farthest from disk 50. Idler gear 44*a* engages sun gear 38. Idler gear 44*a* also engages a planetary gear 46*a*. Planetary gear 46*a* is fixedly mounted on planetary shaft 48*a*, near an end of a planetary shaft 48*a*. Planetary shaft 48*a* extends through a cut away in circular disk 52, and through a cut away in circular disk 56*a*. A fixing shaft 58*a* is attached at one end to disk 54*a* and at another to lever 56*a*. Fixing shaft 58*a* acts as a counterweight mounted between disk 54*a* and lever 56*a*, diametrically opposite moon shaft 60*a* and is adapted in combination with the shaping of lever 56*a* to balance the weight of planetary system 22*a* about planetary shaft 48*a*, thereby providing a smooth balanced rotation about axis 32*a*.

A second end of planetary shaft 48*a* is fixedly attached to disk 54*a* at the centre of disk 54*a*. A housing 62*a* is fixedly mounted to the inner side of circular disk 52 and surrounds planetary shaft 48*a*. Ball bearings 84*a* are mounted in housing 62*a* and are interposed between planetary shaft 48*a* relative to housing 62*a*, thus permitting rotation of shaft 48*a* without housing 62*a*. Attached to the end of housing 62*a* proximate an inner side of lever 56*a* closest to lever 56*a*, is a planetary sun gear 70*a*. An idler gear 72*a* is rotatably mounted on an inner side of lever 56*a* closest to circular disk 54*a* on shaft 53*a*, and engages planetary sun gear 70*a*. A moon gear 74*a* is fixedly mounted to moon shaft 60*a*. Moon gear 74*a* is also engaged by idler gear 72*a*.

Moon member 24*a* is fixedly mounted on moon shaft 60*a* on planetary member 22*a* and is rotatable, about moon axis 34*a* with moon shaft 60*a*. Moon member 24*a* has an extension member 40*a* and a shaft 42*a*. Shaft 42*a* extends from extension member 40*a* in a direction parallel to moon axis 34*a*. Extension member 40*a* is mounted to moon shaft 60*a* near one of its ends 34. Extension member 40*a* is generally rectangular in shape, made of a rigid material, and mounted near one of its ends with its long axis perpendicular to moon axis 34*a*. Object pick-up member 26*a* is fixedly mounted on shaft 42*a* and has a pair of vacuum suction cups 28*a*.

Extension member 40*a* and shaft 42*a* are designed so that suction cups 28*a* have their pick-up surface along moon axis 34*a*.

Mounted on shaft 42*a* atop suction cups 28*a* is a vacuum generator 102*a*. Vacuum generator 102*a* is a venturi vacuum generator that uses compressed air at an inlet and converts this compressed air into a stream of attracted air (ie. a vacuum) at a vacuum outlet. The suction cups 28*a* are connected to the vacuum outlet by a very short hose 25*a* (less than 10 cm in length, and optimally less than 2.5 cm in length). As will be detailed below, this close proximity of vacuum generator 102*a* to suction cups 28*a*, allows for very fast, cut-off of the vacuum at suction cups 28*a*. A vacuum generator 102*a* suitable for use with the feeder is produced by Pisco™ Pneumatic Equipment, sold under model No. VCH10-016C or VCH10-018C. The vacuum generator is designed to operate at a pressure of approximately 72 psi. Advantageously, a vacuum generator of this type has near flat input pressure versus output vacuum characteristics near its chosen operating point. Thus, slight deviations in input pressure about the designed operating point (72 p.s.i.), have minimal effects on suction generated by the vacuum generator.

The inlet of vacuum generator 102*a* is connected to hose 110*a*. The other end of hose 110*a* is connected to nib 104*a*. Hose 110*a* thus provides a means of air communication between vacuum generator 102*a* and nib 104*a*. Nib 104*a* extends in a direction along axis 32*a* from moon shaft 60*a* which is hollow. The hollow interior of moon shaft 60*a* forms an air passage 114*a* from an end connector 106*a* to nib 104*a*. End connector 106*a* is mounted on swivel joint 122*a* which permits end connector 106*a* to rotate about axis 34*a*. End connector 106*a* is connected to an end of hose 112*a*. The other end of hose 112*a* is connected to nib 108*a*. Nib 108*a* extends in a direction perpendicular to axis 32*a* from planetary shaft 48*a* which is also hollow. Planetary shaft 48*a* defines air passage 116*a* which extends from connector 117*a* to nib 108*a*. Connector 117*a* is mounted on swivel joint 121*a* permitting connector 117*a* to rotate about axis 32*a*. Hose 118*a* extends from (connector 117*a* to an electronic control valve (not shown). A hose (also not shown) extends from the electronic control valve to manifold 124. The hose is connected to a nib (not shown) on the manifold. Corresponding electronic control valve 130*b* and nib 120*b*, associated with planetary member 22*b*, are however shown in FIG. 4.

Control valve 130*b* is connected by hose 131*b* to nib 120*b* and controls the air flow to vacuum generator 102*b* (FIG. 1). Control valve 130*b* is a normally closed solenoid valve, having an inlet and outlet. It limits pressurized air from flowing through from the inlet to the outlet, when de-energized and closed; it permits air to flow from inlet to outlet when energized and open. The valve may be energized by application of a +24 volt direct current signal to the solenoid. A suitable electronic control valve for use in this embodiment is sold by MAC™ Valves as part No. 111B/113B-111CA. Nib 120*b* extends from manifold 124 and air passage 119*b* passes through hollow shaft 36.

A connector 126 extending from an end of shaft 36 is connected to a source of pressurized air (not shown).

Control valve 130*b* is electrically connected to output control wires 140*b* and 142*b* which extend from slip ring 37. One of the control wires provides an electric off/on signal to energize and de-energize, thereby opening and closing control valve 130*b*, while the other is a ground connection. Of course, it would be possible to provide the ground connection of the control valve by means of the metal forming the carrier and planetary member. The output control wires 140*b* and 142*b* are fixed relative to disc 52 and make contact with input control wires 39 through slip ring 37. Input control wires 39 are stationary relative to support 16 on the opposite side of slip ring 37. A suitable slip ring for use as part of the feeder is sold by Litton™, as part No. AC4598. This slip ring has eight input and eight output wires and may be used to carry both control and ground signals to the three rotating solenoid control valves (130*b*, and those associated with planetary members 22*a* and 22*c*). The slip ring 37 is mounted about sun axis 30, which is the central axis about which control wires 140*b* and 142*b* (as well as the remaining control wires extending to the remaining control valves) rotate. Two of the wires of the eight wire slip ring are used for each solenoid control valve, while the two remaining wires are unused.

Figure 12:
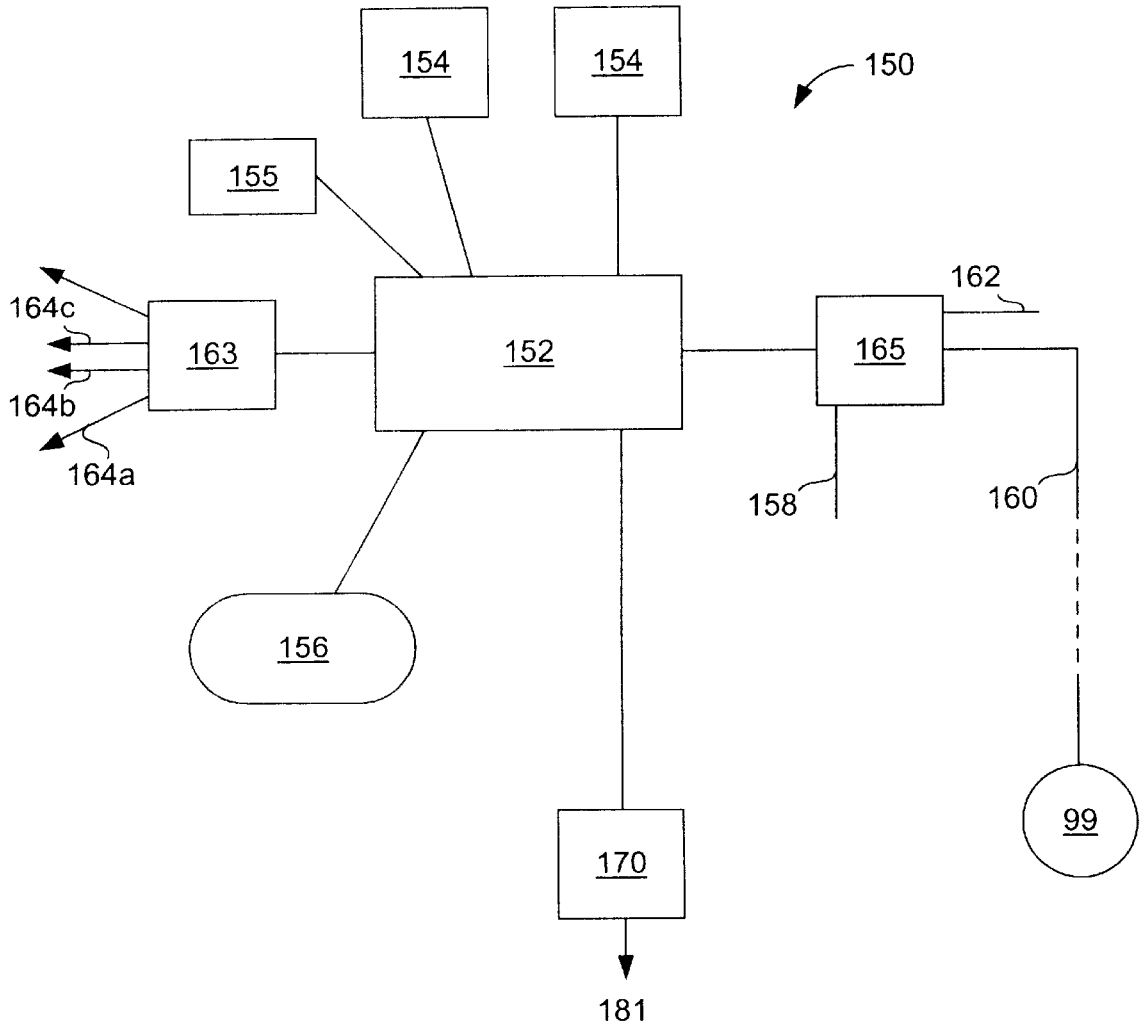
FIG. 12 is a block diagram of a programmable limit switch used in the feeder of FIGS. 1–6.
Figure 13:
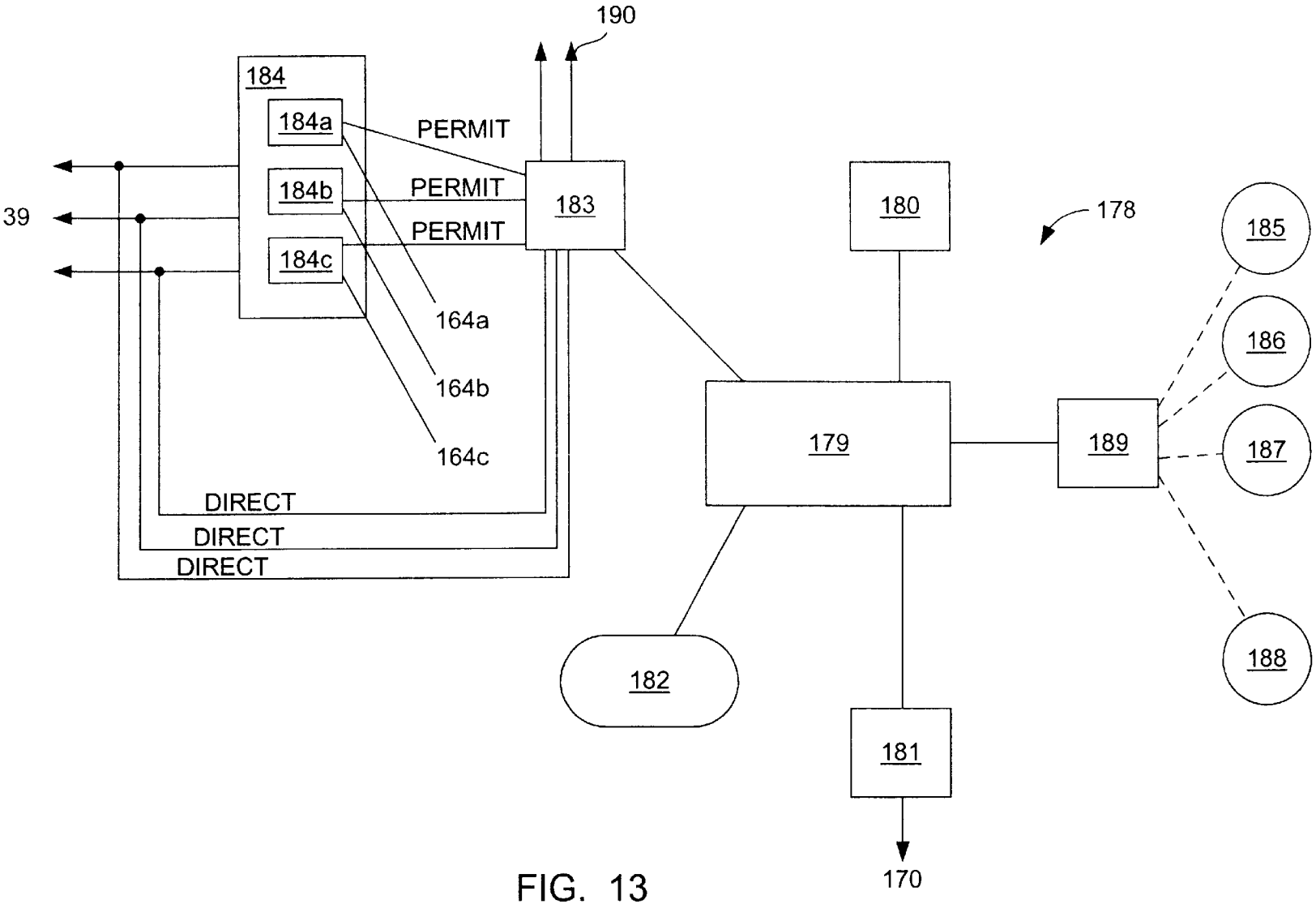
FIG. 13 is a block diagram of a programmable logic controller used in the feeder of FIGS. 1–6.

A computer control system or controller comprising programmable logic controller ("PLC") 178 and programmable limit switch ("PLS") 150, as illustrated in block diagram in FIGS. 12 and 13, forms part of feeder 18.

PLC 178 comprises processor 179, memory 180 (programmable and read-only); keyboard/keypad 182; output port 183; input port 189; and input/output port 181. Memory 180 stores a program governing the operation of PLC 178. This program may be stored in read-only-memory or in dynamic memory and may be input to PLC 178 by means of keyboard 182 or input/output port 181. A further display (not shown) may be interconnected with processor 179. Input/output port 181 is further connected to input/output port 170 of PLS 150. Output port 183 is interconnected to relay bank 184. Relay bank 184 comprises three solid state permissive relays 184*a*, 184*b* and 184*c* relays each controlled by PLC 178. Relay bank 184 has three outputs connected to input control wires 39. Each of the control wires 39 may be independently energized to energize a corresponding control valve at output control wires 140, directly from a PLC output from PLC output port 183. Additionally, connected to control wires 39 are three permissive solid state relays 184*a*, 184*b*, 184*c* that take as their inputs, outputs 164*a*, 164*b*, and 164*c* of PLS 150. Once energized, by the PLC 178 permissive relays provide a pass-through connection to outputs 164*a*, 164*b* and 164*c*. Thus, if the direct PLC outputs at port 183 are not energized, the state of control wires 39 is controlled directly by outputs 164*a*, 164*b* and 164*c* of PLS as long as permissive solid state relays 184*a*, 184*b*, 184*c*, are energized by PLC 178, Alternatively, the direct PLC outputs at port 183 may directly energize control relay 130*b* (and those associated with planetary members 22*a* and 22*c*).

Additional control points on feeder 18, or on a packaging system incorporating feeder 18 may be activated by additional control outputs 190 of control port 183. For example, PLC 178 may control the speed of the motor driving carrier 18 through shaft 36.

Further, input port 189 is in communication with a plurality of control sensors 185, 186, 187, and 188. These sensors may send operating conditions of feeder 18 or other conditions, such as the activation/deactivation of interlocks connected to feeder 18 and a packaging apparatus incorporating feeder 18; the presence or absence of objects to be fed; or the like.

Figure 14A:
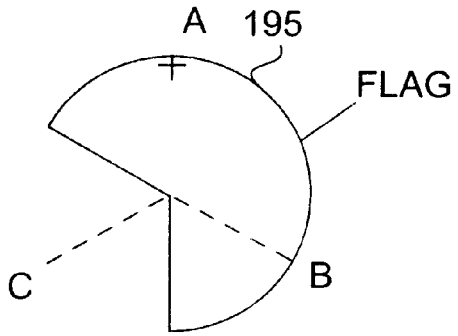
FIG. 14 illustrates a component used in the feeder of FIGS. 1–6.
Figure 14B:
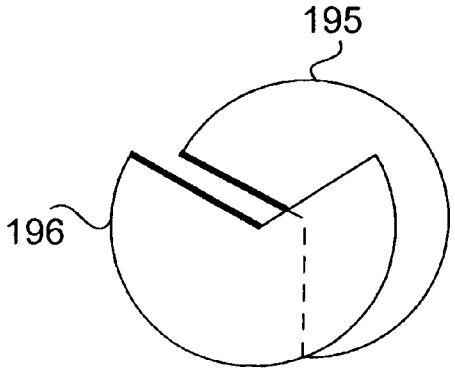

Specifically sensors 185 and 186 are two proximity sensors mounted on feeder 18. Sensors 185 and 186 sense metal flags 195 and 196 mounted about shaft 36. Flags 195 and 196 are illustrated in FIG. 14. Flags 195 and 196 are two flat pieces of metal, forming a 240° segment of a circle. They are rotatably mounted about shaft 36, at orientations offset by 120°. By sensing the presence or absence of each of the flags near the proximity sensors 186, 186, processor 179 of PLC 178, can determine which of the planetary member 22*a*, 22*b* and 22*c*, are within each of three 120° segments about sun axis 30. Thus, PLC 178 through sensors 185 and 186 may determine the presence or absence of any planetary member 22*a*, 22*b* and 22*c* in any segment.

PLS 150, comprises a processor 152, memory 154 (program and read-only), an input keyboard/keypad 156, a plurality of sensor inputs 158, 160, and 162 through input port 165, and control outputs 164*a*, 164*b* and 164*c* through output port 163. An input/output port 170 is further in communication with processor 152. This input/output port 170 allows for the exchange of data and controller programming instructions with PLC 178 or another external computer or controller (not shown). Input/output port 170 is interconnected to input/output port 181. Alternatively, program instructions and parameters may be provided to PLS 150 by means of keyboard/keypad 156. Display information may be presented by PLS 150 at display 155, which is typically an array of alphanumeric LEDs. PLS 150 provides control signals by means of control outputs 164*b*, through wires 39 and 140*b* and 142*b*, and relay panel 184 in order to energize and de-energize, and thereby open and close valve 130*b*. This in turn, may activate and de-activate the flow of compressed air to vacuum generator 102*b* on planetary member 22*b*. Compressed air provided to vacuum generators on planetary members 22*a* and 22*c* are similarly provided by providing control signals at outputs 164*a* and 164*c*. PLS 150 is a programmable limit switch, such as one produced by the PLUS Controls Division of Electrocam Corporation and sold as model no. 5144.

Additionally, with reference to FIG. 12 an electromechanical resolver 99 is connected to one of the sensor inputs 160 and is in communication with PLS 150. Preferably, the resolver is mounted about the drive mechanism that provides rotational power to shaft 36. Alternatively a resolver could be mounted to the periphery of the carrier 20. The resolver 99 is mounted to the drive mechanism of the feeder 18 so that it is mechanically linked with the rotation of carrier 20. The resolver 99 is geared so that one rotation of carrier 20 causes three complete rotations of resolver 99. Additionally, resolver 99, generates a digital eight or ten bit signal, corresponding to an angular rotation of the drive of feeder 18 and therefor, an angular position indicative of the position of carrier 20. However, as resolver 99 is geared to rotate three times for each rotation of carrier 20, the signal provided by resolver 99 is actually indicative of the orientation of any of the planetary members 22*a*, 22*b*, and 22*c* about their planetary axes. This digital eight or ten bit signal is provided to PLS 150 at input 160. Viewed another way, resolver 99 provides PLS 150 a 10 signal indicative of the position of carrier 20 within a 120° segment of the rotation of carrier 20 about sun axis 30. Thus PLS 150 is provided with a sensed signal representative of the angular position of carrier 20, relative to support 16 about sun axis 30 at all times. The position sensed by PLS 150 is provided to PLC 178 by port 170. PLC 178 can calculate the precise position of each pick-up member 26*a*, 26*b*, and 26, by determining the 120° segment in which each planetary member is located using proximity sensors 185 and 186 and discs 195 and 196, and the angular position within each segment using resolver 99 output sensed by PLS 150. An exemplary angular position sensor, used by PLC 178 to determine the angular position of carrier 20 about sun axis 30 is thus comprised of resolver 99, in combination with flags 185, 186 and proximity sensors 195 and 196.

PLS 150 further generates an internal time signal. By using the sensed signal representing angular position, and the internal Little signal, PLS 150, by means of its processor 152, may calculate the rotational speed (angular velocity) of carrier 20 at all times.

Figure 5:
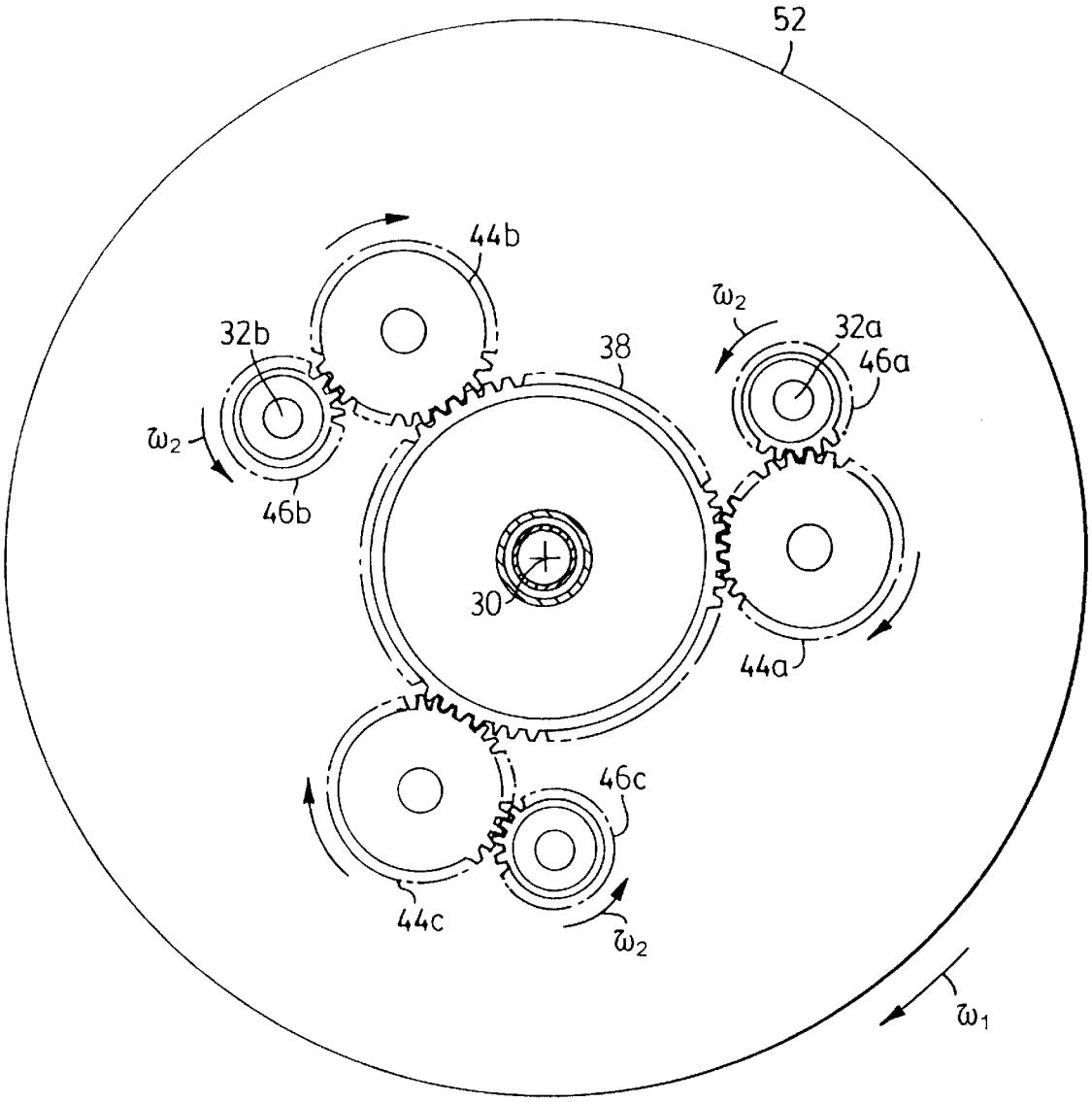
FIG. 5 is an end view of the embodiment of FIG. 1, taken along 5—5 of FIG. 4.
Figure 6:
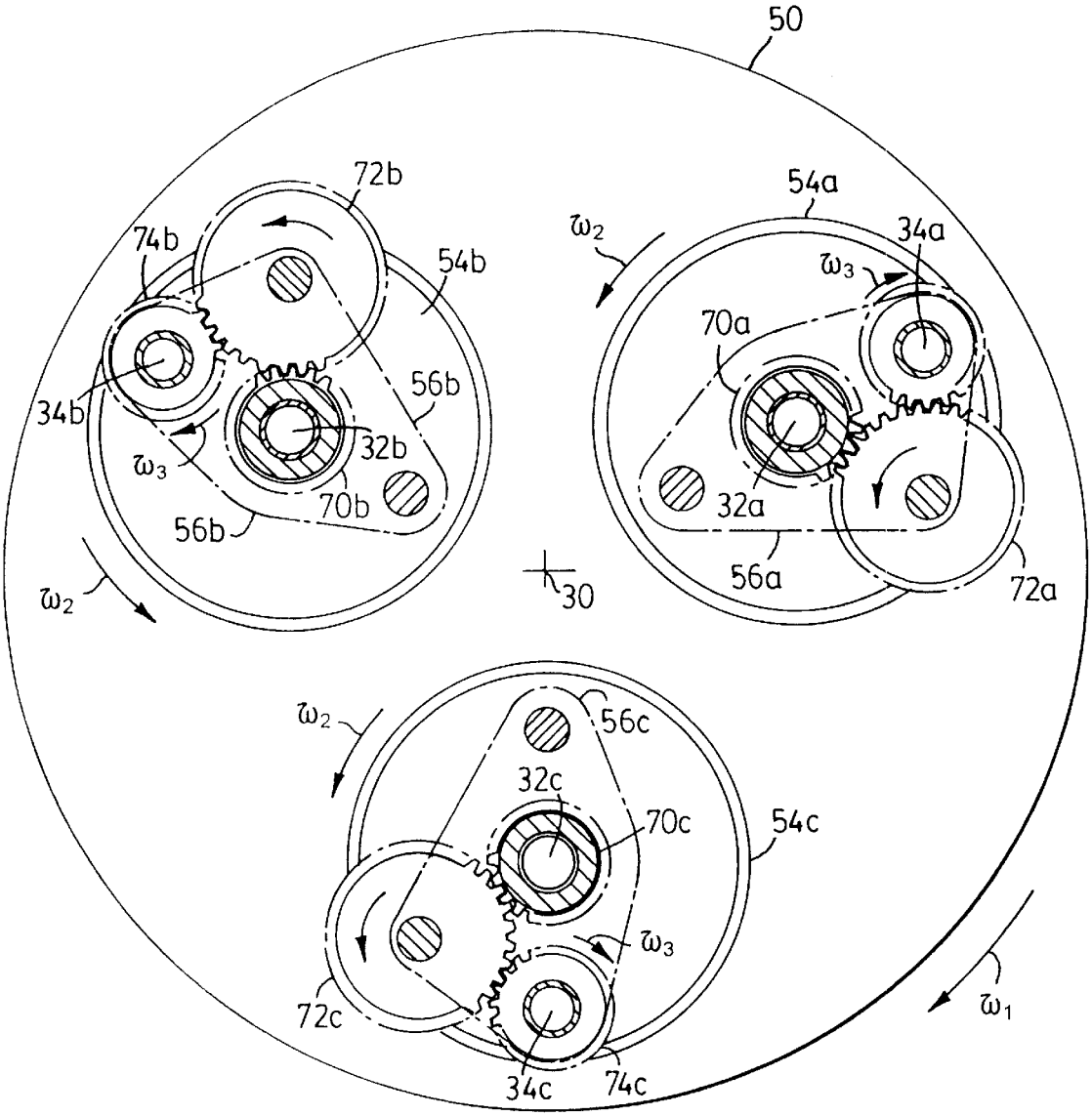
FIG. 6 is an end view of the embodiment of FIG. 1, taken along 6—6 of FIG. 4.

In operation, a source of rotational power, provided by motor (not shown), drives shaft 36 at an angular velocity of $\omega_1$. Compressed air is fed to connector 126. Shaft 36 causes disk 52 and disk 50 along with planetary members 46*a*, 46*b* and 46*c* and their corresponding planetary axis, to rotate about the sun axis 30 at angular velocity $\omega_1$ and relative to sun gear 42. Consequently, idler gear 44*a* is driven about sun gear 38 and engages sun gear 38 to cause idler gear 44*a* to rotate about its shaft 33 in a direction the same as the direction of rotation of disk 52, as illustrated in FIG. 5. Planetary spur gear 46*a* is engaged by idler gear 44*a* and is rotated about its planetary axis 32*a* in the opposite direction as idler gear 44*a* and disc 52 at an angular velocity $\omega_2$. Planetary spur gear 46*a*, fixedly attached to planetary shaft 48*a*, causes planetary shaft 48*a* to rotate with spur gear 46*a*. Planetary shaft 48*a*, attached to disk 54*a* causes disk 54*a* to rotate along with planetary shaft 48*a* at an angular velocity $\omega_2$. As lever 56*a* is attached to disk 54*a* by fixing shaft 58*a*, lever 56*a* rotates with disk 54*a* about axis 32*a*. As disk 54*a* rotates about planetary axis 32*a*, so does moon shaft 60*a* and its moon axis 34*a*.

Planetary sun gear 70*a* is attached to housing 62 and is stationary with respect to disk 52. Idler gear 72*a*, secured to lever 56*a* by shaft 53, is driven about and engages planetary sun gear 70*a*. Idler gear 72*a* thereby rotates about shaft 53*a* in the same direction of rotation as disk 56*a*. Moon spur gear 74*a* is engaged by idler gear 72*a* and moon spur gear 74*a* thereby rotates in the opposite direction as idler gear 72*a* and disc 54*a*, with an angular velocity $\omega_3$ equal in magnitude to $\omega_2$. As spur gear 74*a* is fixedly attached to moon shaft 60*a*, moon shaft 60*a* rotates with moon spur gear 74*a*. Moon member 24*a* rotates along with moon shaft 60*a*.

The gear ratios of sun gear 42, idler gear 44*a* and planetary spur gear 46*a* in this embodiment are chosen so that planetary system 21*a* and hence moon member 24*a* rotates 3 times about planetary axis 32*a* for each rotation of carrier 20 about its axis of rotation 30 (ie. $\omega_3/\omega_1=3$). The gear ratios of planetary sun gear 70*a*, planetary idler gear 72*a* and moon gear 74*a* are chosen so that moon member 24*a* rotates once about moon axis 34*a* for every rotation of sun member 22*a* about planetary axis 32*a*, but in the opposite direction (ie. $\omega_2/\omega_1=-1$).

As pick-up member 26*a* rotates in a direction opposite the direction of rotation of planetary member 22*a* at the same angular velocity as planetary member 22*a*, pick-up member 26*a* and suction cups 28*a* will always remain generally outwardly facing. Particularly, extension member 40*a* is mounted so that pick-up member 26*a* is always outwardly facing with respect to axis 30.

Figure 2:
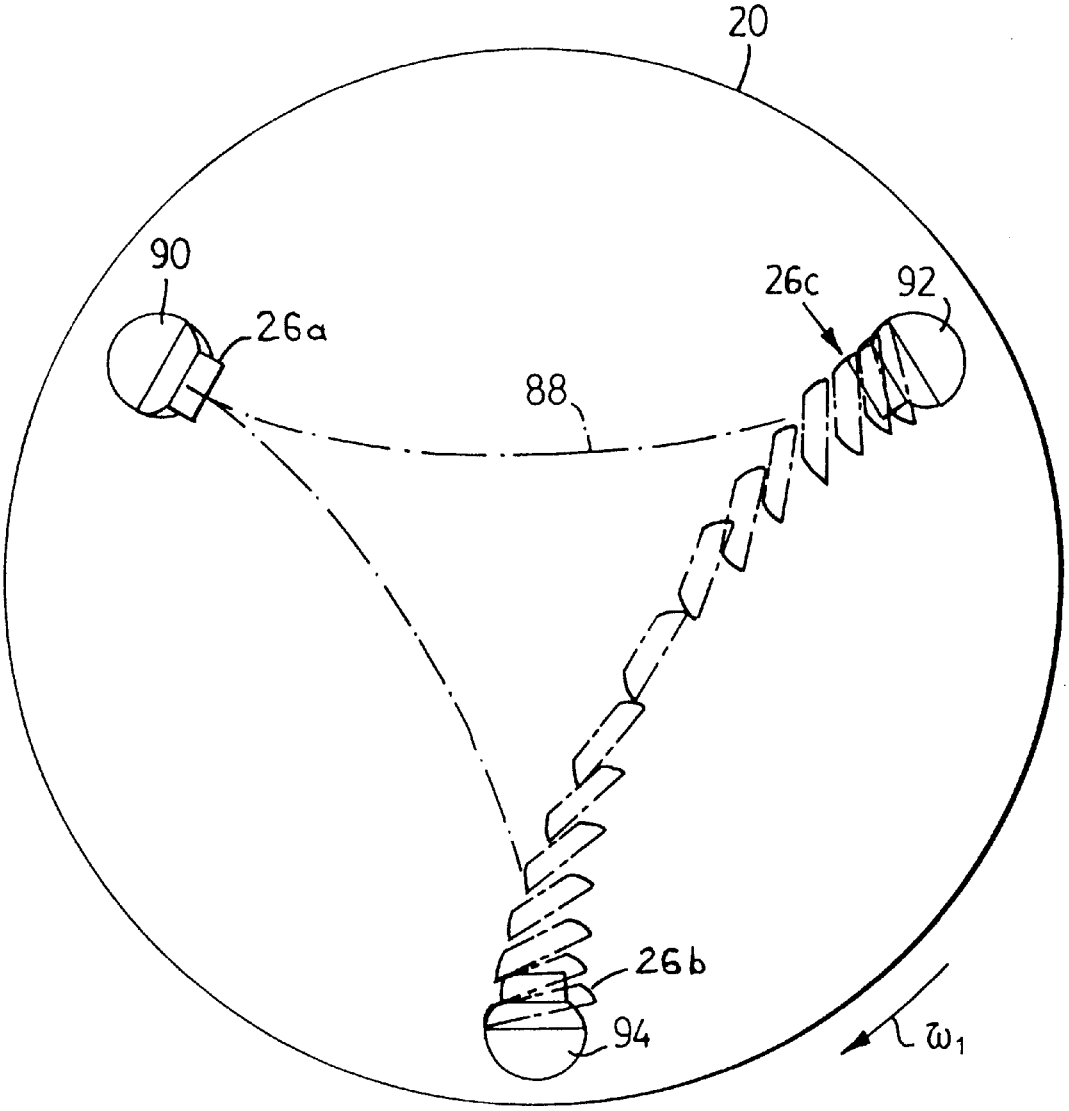
FIG. 2 is a schematic of the embodiment of FIG. 1, in operation.

As carrier member 20 rotates, pick-up member 26*a* traverses a generally triangular trajectory 88 as shown in FIG. 2. At the vertices of this triangular trajectory 88, the velocity of suction cups 28*a* in a direction tangent to the rotation of the carrier is zero. This zero tangential velocity results from the contribution of the rotation of pick-up member 26*a* about axes 34*a*, 32*a* and 30. Zero tangential velocity at the vertices is achieved through a balancing choice of the ratios of rotation of planetary member 22*a* to carrier member 20; the positioning of axes of rotation 34*a*, 32*a* and 30 and the choice of the length of extension member 40*a*, as will be described later in further detail.

Figure 2A:
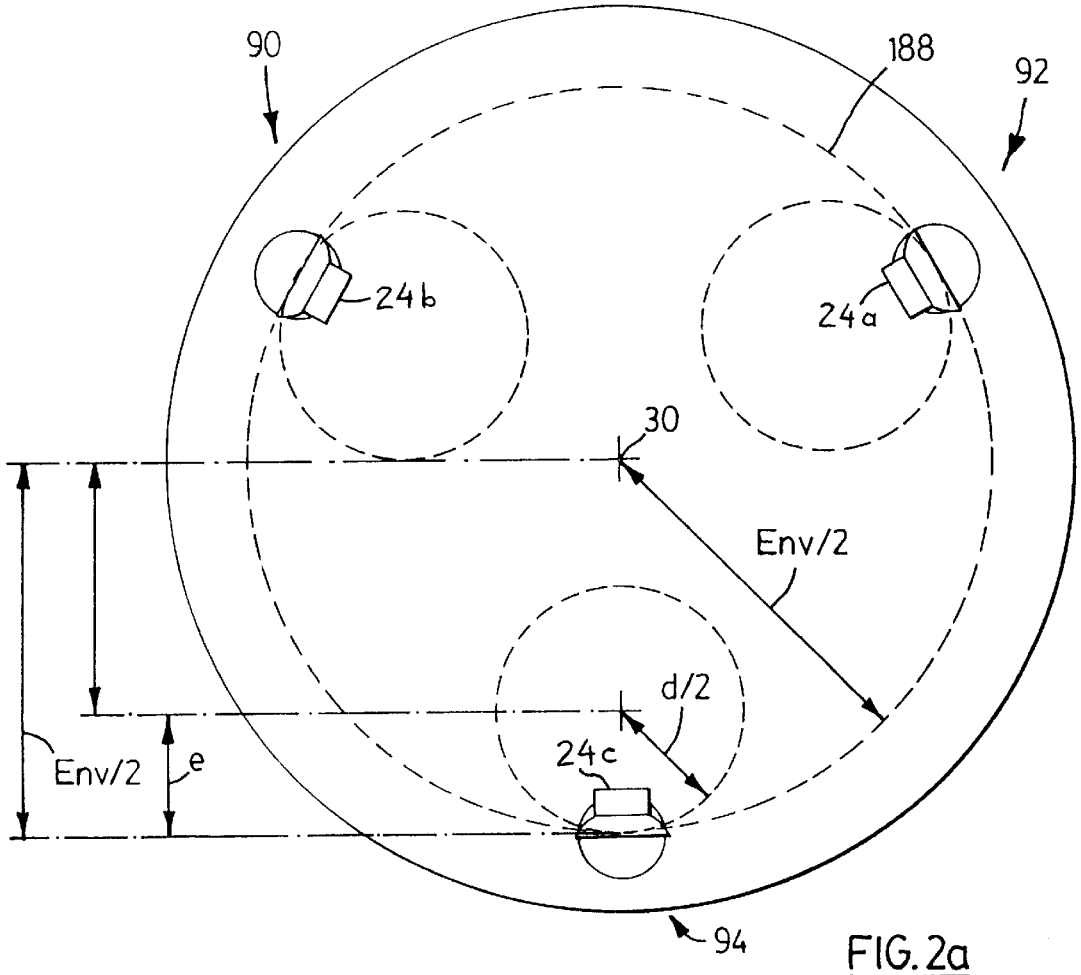
FIG. 2*a* is another schematic of the embodiment of FIG. 1.
Figure 3:
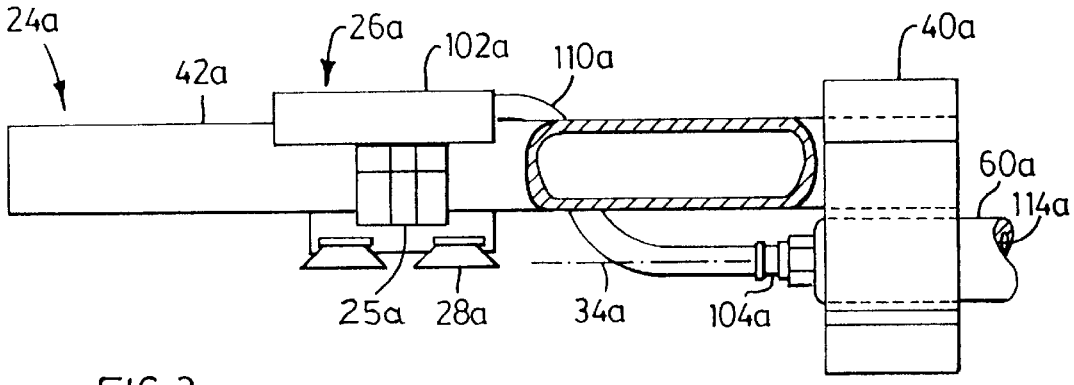
FIG. 3 is a scrap view of a portion of the object feeder of FIG. 1, marked as 3 in FIG. 4.

In FIG. 2*a*, all three pick-up members 26*a*, 26*b* and 26*c* are illustrated again, is showing how the apparatus is arranged so that each pick up member will reach a vertex at the same instant in time.

Referring again to FIG. 2, as pick-up member 26*a* passes along its triangular trajectory, suction cups 28*a* pass through pick-up location 90. Located at pick-up location 90 is a carton magazine or feeder (lot shown) for holding folded cartons. Suction cups 28*a* make contact with a top-most folded carton at pick-up location 90 while travelling in a direction perpendicular to the planar surface of the folded cartons. Before pick-up member 26*a* passes through pick-up location 90, an electric control valve (not shown, but corresponding to control valve 130*b* associated with planetary member 22*b*) receives a signal from controller (PLS 150 and PLC 178) (FIGS. 12, 13), to provide pressurized air to the inlet of vacuum generator 102*a*.

PLC 178 and PLS 150 (FIG. 12), are programmed to activate (ie. energize) the control valve associated with vacuum generator 102*a* in response to sensing the angular location of planetary member 22*a* on carrier 20, relative to sun axis 30. With reference to FIGS. 2 and 2*a*, typically, the control valve is activated about 60° (measured about sun axis 30) before pick-up member 26*a* reaches pick-up location 90, approximately rotationally half-way between drop-off location 94 and pick-up location 90. The control valve is initially energized by a PLC output of PLC output port 183.

In response to receiving a signal at the control valve, pressurized air is fed to vacuum generator 102*a* via air passages or cavities 126, 116*a*, 114*a* and hoses 118*a* and 112*a*. Vacuum generator 102*a* converts this pressurized air into a constant source of suction. As noted, because of the relatively flat relationship between vacuum output and air pressure input, the precise pressure at the vacuum generator inlet may vary somewhat from its design point without materially affecting the operation of the vacuum cups 28*a*. This suction is fed to suction cups 28*a*, by hose 25*a*, thereby causing a folded carton at location 90 to adhere to suction cups 28*a*. The electrical control valve retains pressurized air at vacuum generator 102*a* and thereby suction at suction cups 28*a* until suction cups 28*a* releases the can near drop-off location 94.

Suction cups 28*a* transport a folded carton from pick-up location 90 along trajectory 88 to operating location 92. As the folded carton travels from pick-up location 90, suction cups 28*a* remain outwardly facing because of the rotation of suction cups 28*a* in an opposite direction and at an angular velocity equal to that of planetary member 22*a*.

As the shaft 36 and manifold 124 rotate, the distance between axis 32*a* and axis 30 does not change. Thus the distance between a nib on the manifold and its corresponding, connecting nibs on a planetary member does not change.

As connector 117*a* attached by swivel joint 121*a* to swivel about axis 32*a*, hose 118*a* does not become twisted as manifold 124 rotates.

The same principle applies to hose 112*a* between nib 108*a* and connector 106*a*, the latter of which is adapted to swivel about axis 34*a* by means of swivel joint 122*a*, and in respect of hose 110*a* which links vacuum generator 102*a* to nib 104*a*. Nib 104*a* need not rotate about axis 34*a* because there is no movement of shaft 42*a* relative to shaft 60*a*.

Located at operating location 92 is a carton expander unit (not shown). At operating location 92, the folded carton has zero tangential velocity. The carton expander is located tangent to carrier 20 at operating location 92. The expander engages the folded carton and pulls the carton apart in a direction radial to carrier 20. Suction cups 28*a* further transports the unfolded carton along trajectory 88 to off-loading location 94. As suction cups 28*a* approach off-loading location 94 PLC 178 switches the functioning of relay bank 184, so that energy provided to the control valve is no longer provided by a direct PLC output of PLC output port 183 of bank 184. Instead, energy is provided to the control valve by PLS 150 through output 164*a*, conducted through a permissive relay 184*a*. PLS 150 continues to energize the control valve associated with planetary member 22*a* until the suction cups reach a precise "turn-off" point. At this turn-off point, the control valve is de-energized and the negative pressure at suction cups 28*a* is released. However, before suction cups 28*a* release an attached carton, the vacuum at suction cups 28*a* must be released. Thus, pressurized air at the vacuum generator associated with suction cups 28*a* must be cut off, and the vacuum at suction cups 28*a* must be released. As the distance between the control valve and the vacuum generator associated with cup 28*a* is finite and because air must bleed into the vacuum passage connected to suction cups 28*a* to release the vacuum, the time and location at which the control valve associated with planetary member 22*a* is closed (ie. the turn-off point) and the corresponding time and location (ie. the "drop-off point") where an object attached to suction cups 28*a* is released are not identical. At slow speeds of rotation, the time difference between turn-off of the control valve and the drop-off of an attached carton is insignificant. As the rate of rotation of the feeder increases, the time difference between the turn-off and drop-off points results in an increased angular difference between the turn-off and drop-off point.

Figure 15:
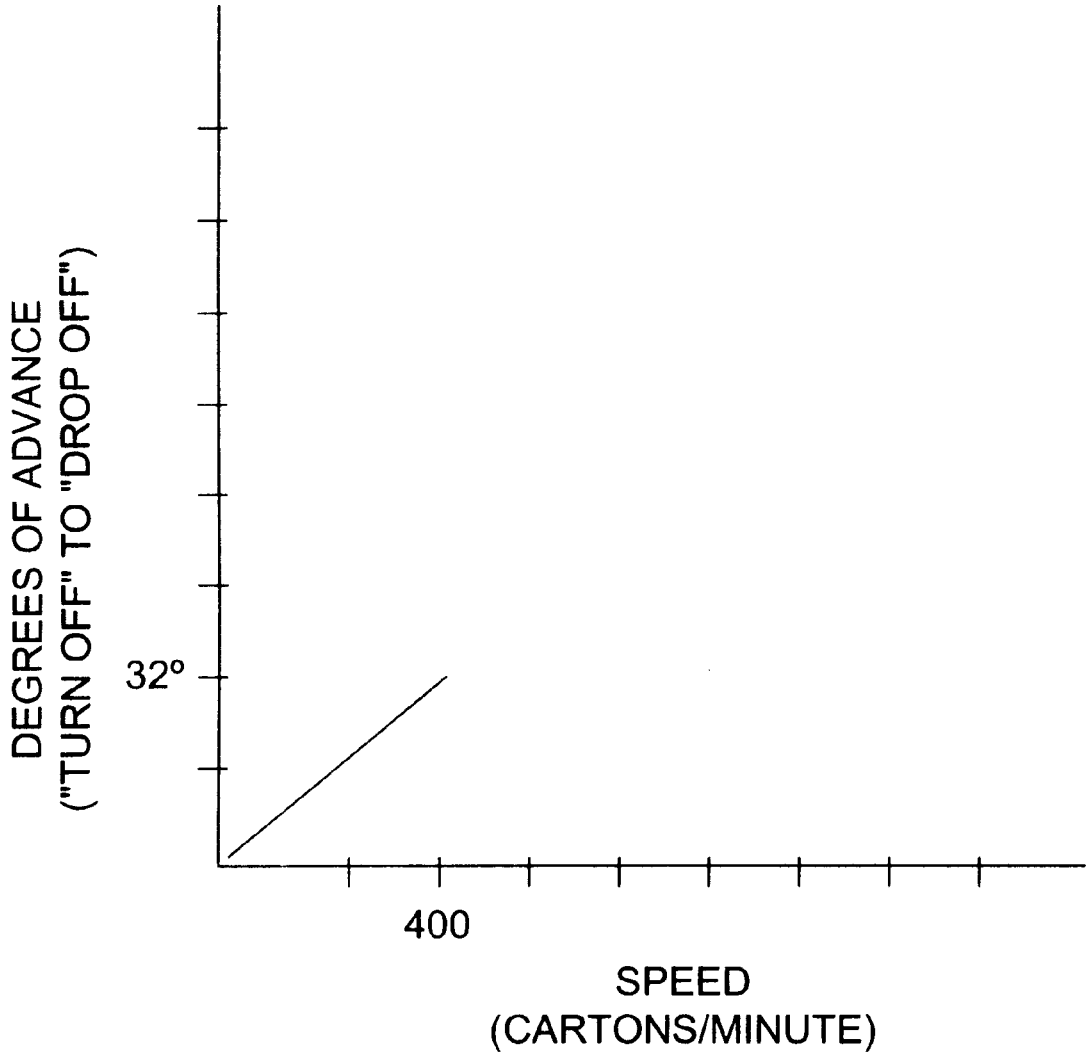
FIG. 15 illustrates the relationship between valve turn-off points and drop-off points, for various carton feeder speeds, as used by a speed compensation method used by the controller of FIG. 12.

Accordingly, PLS 150 is adapted by means of software stored in memory 154 to dynamically adjust the turnoff point for the control valve, associated with planetary member 22*a*, relative to the drop-off location 94. This function of PLS 150 is referred to as "speed compensation". The program is adapted so that, as the rotational speed of feeder 18 increases, as sensed by resolver 99, and PLS 150, the position of the control valve turn-off point, for a control valve associated with a pick-up member approaching drop-off location 94 is advanced linearly as shown in FIG. 15. Specifically, the turn-off point is advanced approximately 250° about sun axis 30 for every 1000 rpm of carrier 20. Thus, as illustrated in FIG. 15, for speeds of rotation allowing for the delivery of 400 objects/minute (=133 rpm), the turn-off point for suction cups 28*a* is advanced by approximately 32° (as measured about axis 30). That is, the vacuum at suction cups 28*a* is turned off as the planetary axis 32*a* associated with suction cups 28*a* is approximately thirty twos degrees away from drop-off location 94. This advancement is directly related to the approximate time required to stop air flow to vacuum generator 102*a* and bleed the vacuum at suction cups 28*a*. As vacuum generator 102*a* is advantageously close to suction cups 28*a*, and the associated control valve is mounted in proximity to the vacuum generator 102*a*, a very quick release of the vacuum at the suction cups 28*a* is possible. If the vacuum generators were eliminated entirely, or moved away from the suction cups, the time required to bleed the vacuum at the suction cups would increase significantly, making high speed delivery of objects, difficult, if not impossible.

Once the vacuum at suction cups 28*a* is released, the unfolded carton having near zero tangential velocity at off-loading location 94 will be released.

Located at drop-off location 94 is a transport mechanism (not shown) on which the unfolded carton is released. The unfolded carton is then transported by the transport mechanism away from the carton feeder to a location (not shown) where the carton is further processed.

Pick-up location 90, operating location 92 and drop-off location 94 are equally spaced from each other along the periphery of carrier 20. While pick-up member 26*a* follows trajectory 88, pick-up member 26*c* follows the same trajectory, but lags by 120° of rotation of carrier 20. Similarly, pick-up member 26*c* further lags 120° behind pick-up member 26*b*. Thus, when pick-up member 26*a* passes through pick-up location 90, pick-up member 26*c* passes through off-loading location 94, and pick-up member 26*b* passes through operating location 92. Vacuum generators 102*b* and 102*c* are actuated as pick-up members 26*b* and 26*c* pass through pick-up location 90. Using speed compensation, as described above, the cartons picked up by pick-up members 26*b* and 26*c* are released as pick-up members 26*b* and 26*c* pass through off-loading location 94. Again the pick-up and release is controlled by a controller comprised of PLC 178 and PLS 150. Thus, for each rotation of carrier 20 about axis 30, three folded cartons are picked-up at pick-up location 90, expanded at operating location 92 and released at off-loading location 94.

While a controller comprised of PLC 178 and PLS 150 has been described with reference to a rotary feeder having three pick-up heads, each for rotation about three axes, a person skilled in the art will appreciate that such a controller could easily be associated with a rotary feeder having any number of heads, each rotating about one, two, three or more axes of rotation. Such a controller could similarly implement the speed compensation described above. Additionally, in the event that PLC 178 is not used for sensing other operating conditions, a controller could be implemented solely using PLS 150; alternatively the controller could be implemented solely by PLC 178.

Additionally, as the pick-up and drop-off location of each of the pick-up members 26*a*, 26*b* and 26*c* are governed by a controller comprised of PLC 178 and PLS 150, pick-up, operating and drop-off locations may be re-arranged through software control loaded into PLC 178 and/or PLS 150, at any time.

In some applications, it is possible for the vacuum generator to be eliminated and a vacuum applied through the entire air system. As will be understood, however, the shorter the distance between each of the suction cup 28*a*, 28*b*, and 28*c* and the associated control valve, the more accurate control of suction at suction cups 28*a*, 28*b* and 28*c* will be possible.

Embodiment 2

Figure 9:
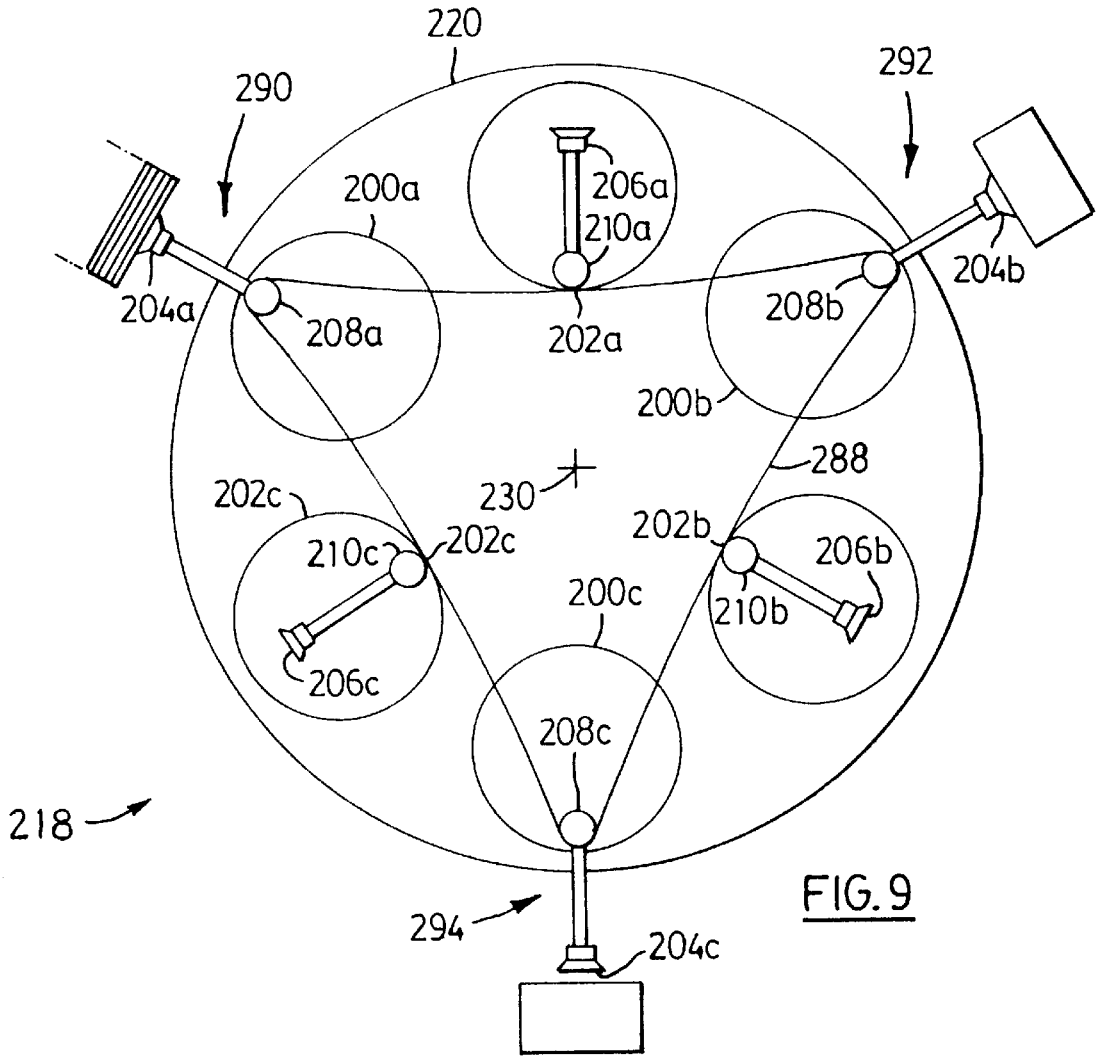
FIG. 9 is a schematic view of another object feeder having six pick-up heads in accordance with another embodiment of the present invention in operation.

With reference to FIG. 9, there is provided a rotary object feeder generally designated 218 having two sets of three identical planetary members; a first set 200*a*, 200*b*, 200*c*; and a second set 202*a*, 202*b*, and 202*c*.

The size of planetary members 200, 202 and the carrier member 220 are chosen, so that two sets of three planetary members may be mounted on a single carrier member.

In this embodiment, the six planetary members are arranged to function as two sets of three planetary members. The first set comprising planetary member 200*a*, 200*b*, and 200*c* having moon members 210*a*, 210*b* and 210*c* mounted thereon. Each moon member further comprises a pick-up member 206*a*, 206*b* and 206*c*. Each pick-up member 206*a*, 206*b* and 206*c* travels along hypocycloidal trajectory 288 generally in the triangular pattern illustrated.

Each of the sets of moon members 204 and 210 rotate three times about a planetary axes for each rotation of carrier 220 about a sun axis, in an opposite direction as carrier 220. The pick-up members 204, travel along the trajectory 288 but lag pick-up members 206, by 60° of rotation of carrier member 220 about sun axis 230.

The vertices of the trajectory 288 are located at positions, 290, 292 and 294. Each of the pick-up members 204 and 206 pass through each vertex once for every rotation of carrier 220. Located at these vertices are a folded carton feeder, an operating unit and a transport unit respectively, as with the embodiment 1 shown in FIGS. 1–6. As in Embodiment 1 of FIGS. 1–6, a vacuum generator associated with each of members 204, and 206 is actuated as each of the pick-up members passes through the pick-up location 290. Suction cups forming pick-up members 204 and 206 pick-up a folded carton at pick-up location 290, transport it to operating location 292 where the folded carton is expanded, transport it to a further off-loading location 294 where it is released.

Once again, the presence or absence of suction at the suction cups of pick-up members 204*a*, 204*b*, 204*c* and 206*a*, 206*b*, and 206*c* is controlled by a controller system similar to controller comprised of PLS 150 and PLC 178 of FIGS. 12 and 13, and associated electric control valves (not shown) are mounted to the rotating carrier portion of the feeder, and provided with control signals by means of control wires connected by way of a slip ring. The controller, again, allows for the independent control of suction at the pick-up heads, thereby allowing for independent control of each of the pick-up heads 204*a*, 204*b*, 204*c*, 206*a*, 206*b*, 206*c*, similar to the control of suction at suction cups 28*a*, 28*b* and 28*c* of embodiment 1. The controller of this embodiment, again implements the speed compensation, as described above, to ensure proper release of articles picked up by pick-up member 204 and 206 at location 294.

With the proper choice of angular velocities, position of axes and the proper mounting of the pick-up members, each suction cup will pass through pick-up 290, operating 292 and off-loading location 294 with zero tangential velocity.

Embodiment 3

Figure 10:
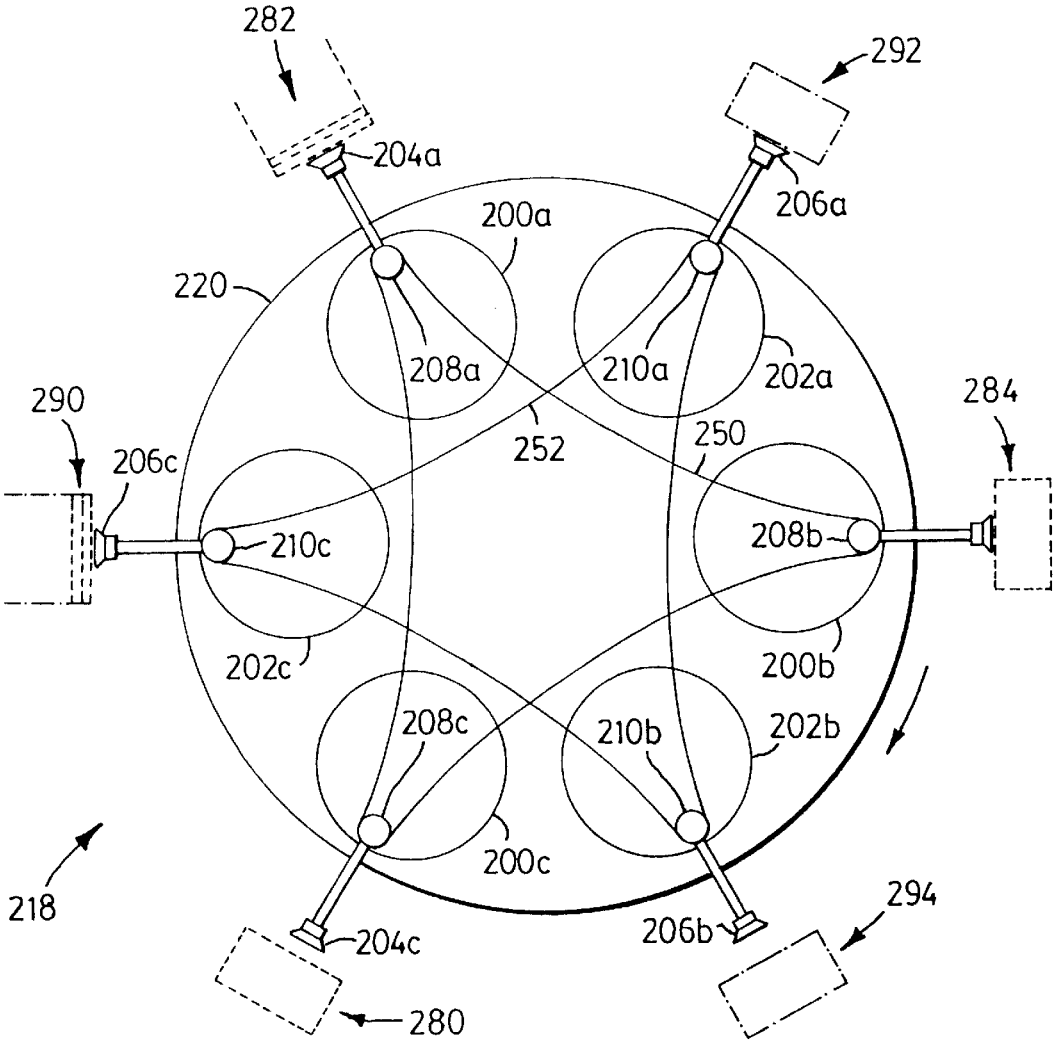
FIG. 10 is a schematic view of another object feeder having six pick-up heads in accordance with another embodiment of the present invention.

It is possible that the general concept of the invention may be adapted to allow several planetary members to each follow a different trajectory. In FIG. 10, pick-up members of each set of three planetary members follow a different trajectory.

Accordingly, in operation one set of moon members 208*a*, 208*b*, 208*c* follows a generally triangular trajectory marked as 250. A second set of moon members 210*a*, 210*b* and 210*c* follows a similar generally triangular trajectory generally marked as 252. The vertices of each trajectory of each set of suction cups associated with pick-up members 208*a*, 208*b*, 208*c* and 210*a*, 210*b* and 210*c* are at different locations relative to the frame support (not shown). A rotary feeder according to such an embodiment may be adapted for two pick-up locations 280, 290, two operating locations 282, 292 and two off-loading locations 284, 294. Each set of pick-up members 208 and 210 will pass along a generally triangular trajectory 250 or 252 having one of the pick-up locations 280 or 290; one of the operating locations 282 or 292 and one of the off-loading locations 284 or 294 at its vertices. The rotary feeder may be used to feed six folded cartons from two different pick-up locations to two different off-loading locations for each rotation of carrier member 220.

Once again, the presence or absence of suction at the suction cups of pick-up members 204*a*, 204*b*, 204*c* and 206*a*, 206*b*, and 206*c* is controlled by a controller similar to Embodiment 1. This controller, again implements the speed compensation to ensure proper release of picked-up articles at location 294 for pick-up members 206 and location 280 for pick-up members 204.

Additionally, as the controller dynamically controls the provision of suction at the suction cups of pick-up members 204 and 206, it is possible to use program control to de-activate either set of pick-up members 204 or 206, individually. This, for example, might allow for the replenishment of cartons to be fed at locations 290 or 282 without interrupting the transfer of cartons by the remaining set of pick-up members.

Embodiment 4

Figure 11:
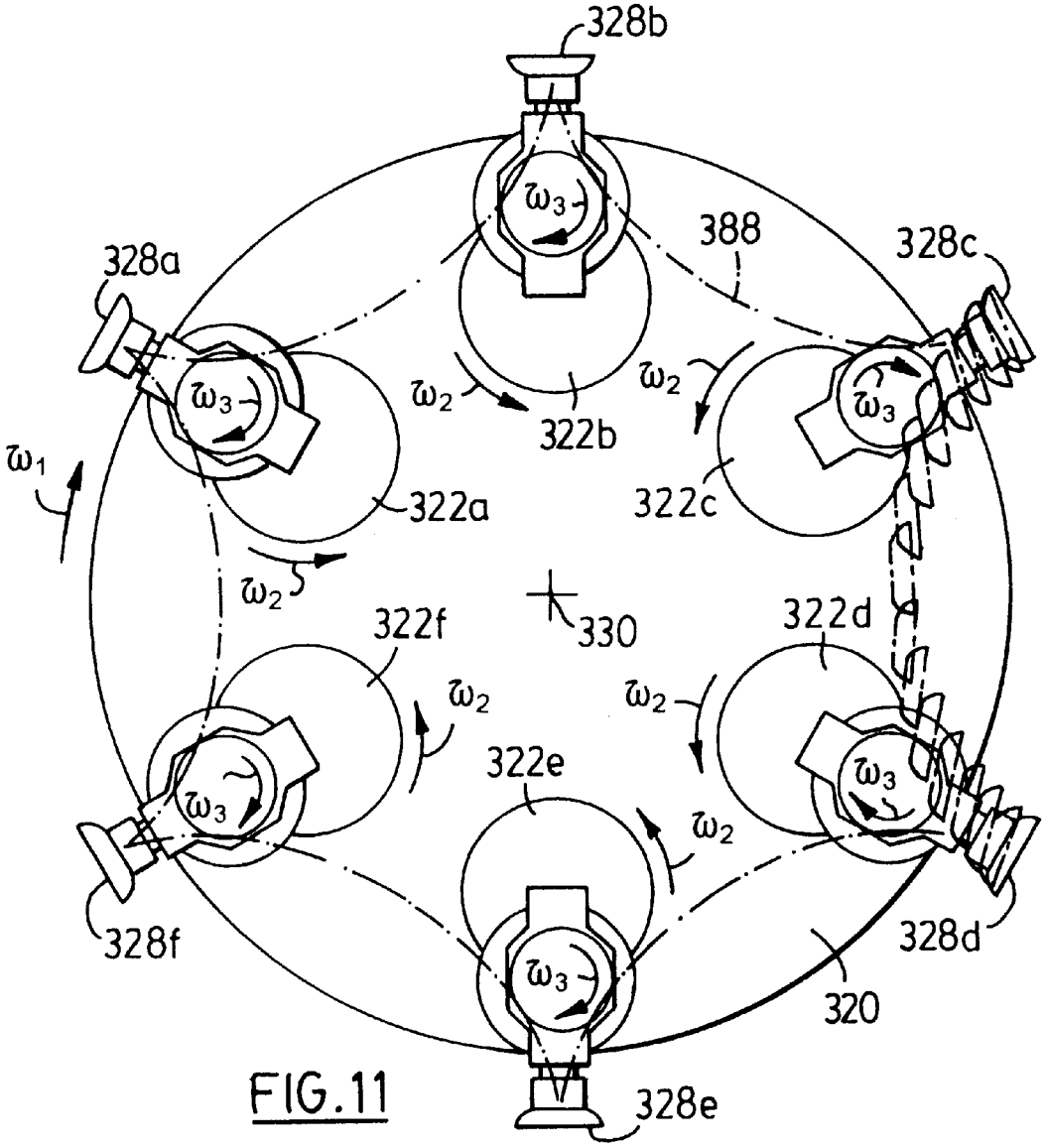
FIG. 11 is a schematic of the embodiment of FIG. 7, in operation.
Figure 11A:
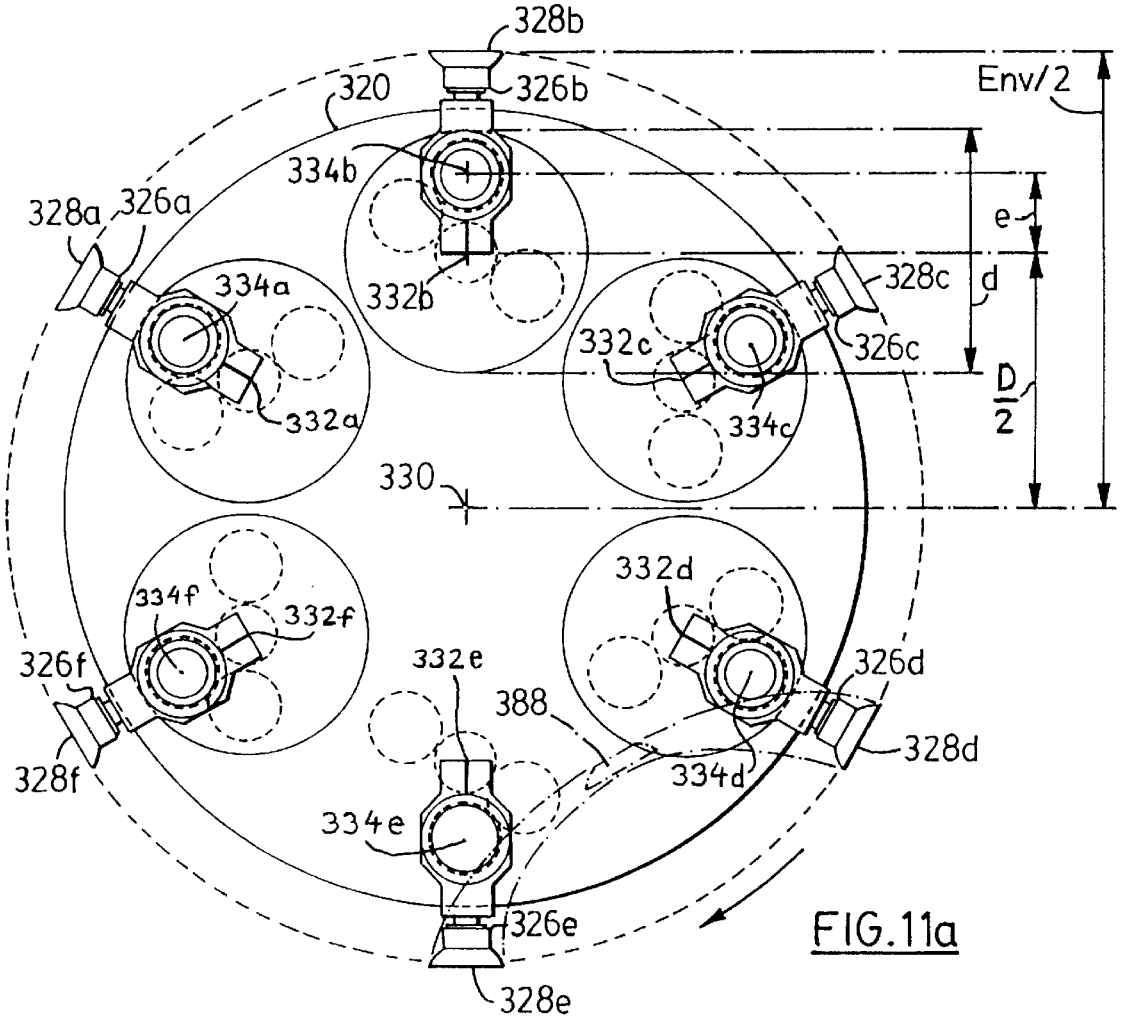
FIG. 11*a* is a schematic view of the object feeder of FIGS. 7 and 11.

The general inventive concept of the present invention, is not limited to rotary feeders having pick-up members rotating at three times the rate of a carrier member. FIGS. 7, 8, 11 and 11*a*, for example, illustrate a rotary object feeder having six pick-up members. In this embodiment, each planetary member 322*a*–322*f* is geared so that it rotates six times about planetary axes 332*a*–332*f* for each rotation of carrier member 320 about sun axis 330. The trajectory 388 of each planetary member is accordingly pseudo-hexagonal with six vertices, as shown in FIGS. 11 and 11*a*. As the relative radii and rates of rotation of carrier member 320 to planetary members 322*a*–322*f*, differs from the Embodiments 1, 2 and 3, the length of mounting shafts 326*a*–326*f* are chosen to achieve a minimum tangential velocity of pick-up members 328*a*–328*f* at these vertices. Accordingly, the carton feeder may be adapted to have two sets of pick-up, operating, and off-loading locations, or it may he adapted to have a single pick-up and off-loading location with four operating locations, depending on the requirements of the particular application.

Suction at the suction cups of pick-up members 328*a*–328*f* is controlled by a computer controller (similar to the controller of embodiment 1) and associated electric control valves and vacuum generators proximate the pick-up members, as described above. The controller, independently controls suction at each of the suction cups associated with pick-up members 328*a*–328*f*. Thus, the pick-up, and operating locations may be dynamically adjusted by program control implemented by an associated controller. For example, the controller could direct pick-up members 328*a*, 328*b* and 328*c* to pick-up cartons to be delivered to a single off-loading location, from three distinct pick-up locations. Similarly, the pick-up or drop-off location for any pick-up member could be changed dynamically, as the feeder is in operation. Thus, the controller could direct a pick-up head to feed from a first location until cartons at that location are exhausted, then the controller could direct the feeder to feed cartons from a second location until cartons at the first location are replenished, at which time cartons could be fed again from the first location. Of course, any desired combination of pick-up and drop-off locations is possible: the key is that suction at each pick-up member is independently controlled by a controller (similar to the controller of embodiment 1), so that program control may direct the pick-up and drop-off of objects by each pick up member 328*a*–328*f*.

Figure 7:
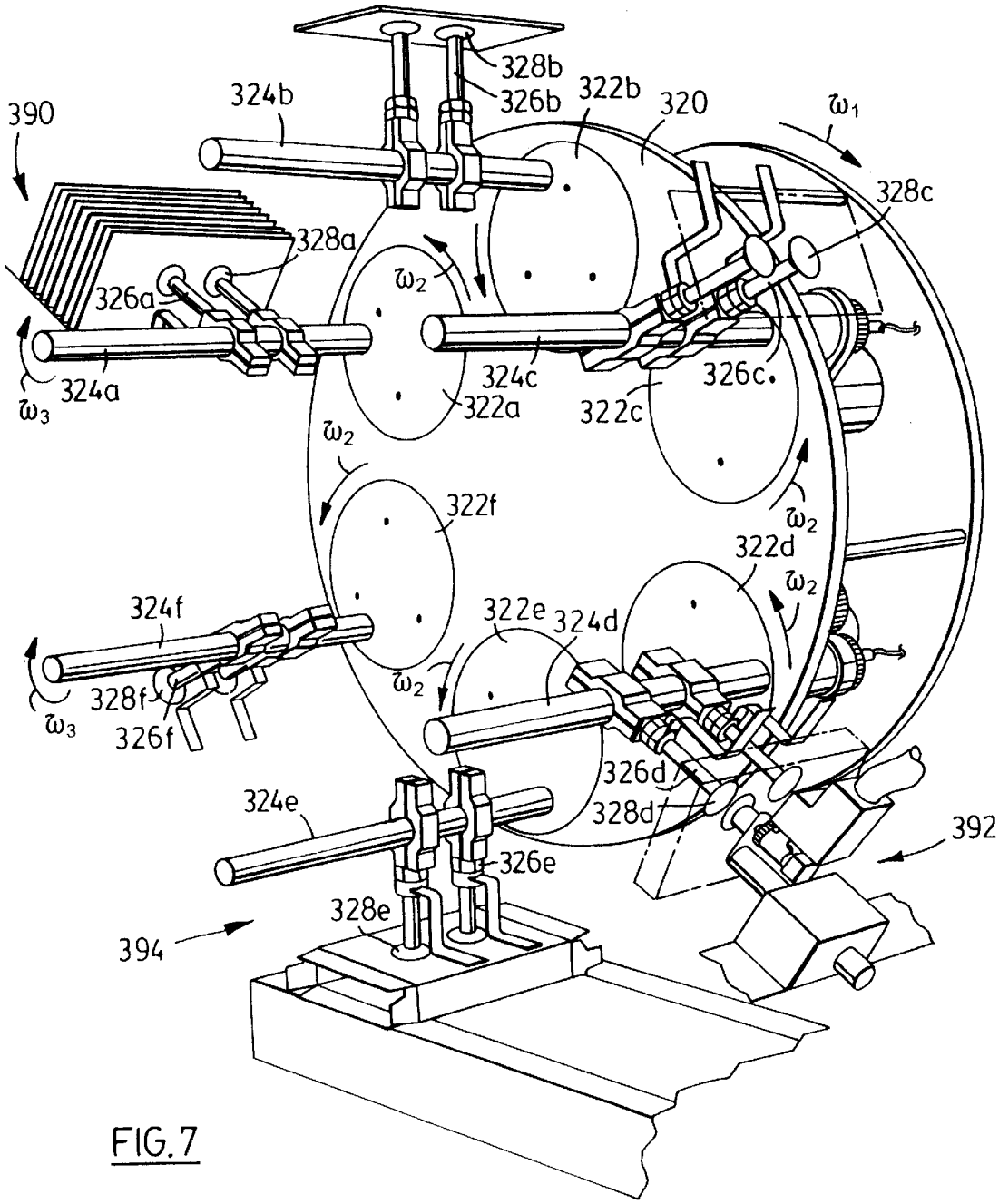
FIG. 7 is a perspective view of an object feeder having six pick-up heads in accordance with another embodiment of the present invention.

In the embodiment illustrated in FIG. 7, each object pick-up member will pick-up a folded carton from a magazine at a loading station 390. The folded carton is then rotated about the path shown in FIG. 11 to a carton erection station 392. At station 392 a conventional carton erection apparatus is located, such as a vacuum source mounted on a reciprocating arm. The motion of the pick-up member may be such as to obviate the necessity for a separate reciprocating arm. Once the carton has been erected the carton is rotated to an unloading station where the vacuum at the suction cups in turned off, and the carton is allowed to he deposited onto a conveyor which removes the carton from the station. If the carton is stationary at the station 394, this carton feeder will be particularly suitable for use in combination with a hesitating carton loading system such as that disclosed in U.S. Pat. No. 5,371,995 issued Dec. 13, 1994 to Guttinger et al.

Figure 8:
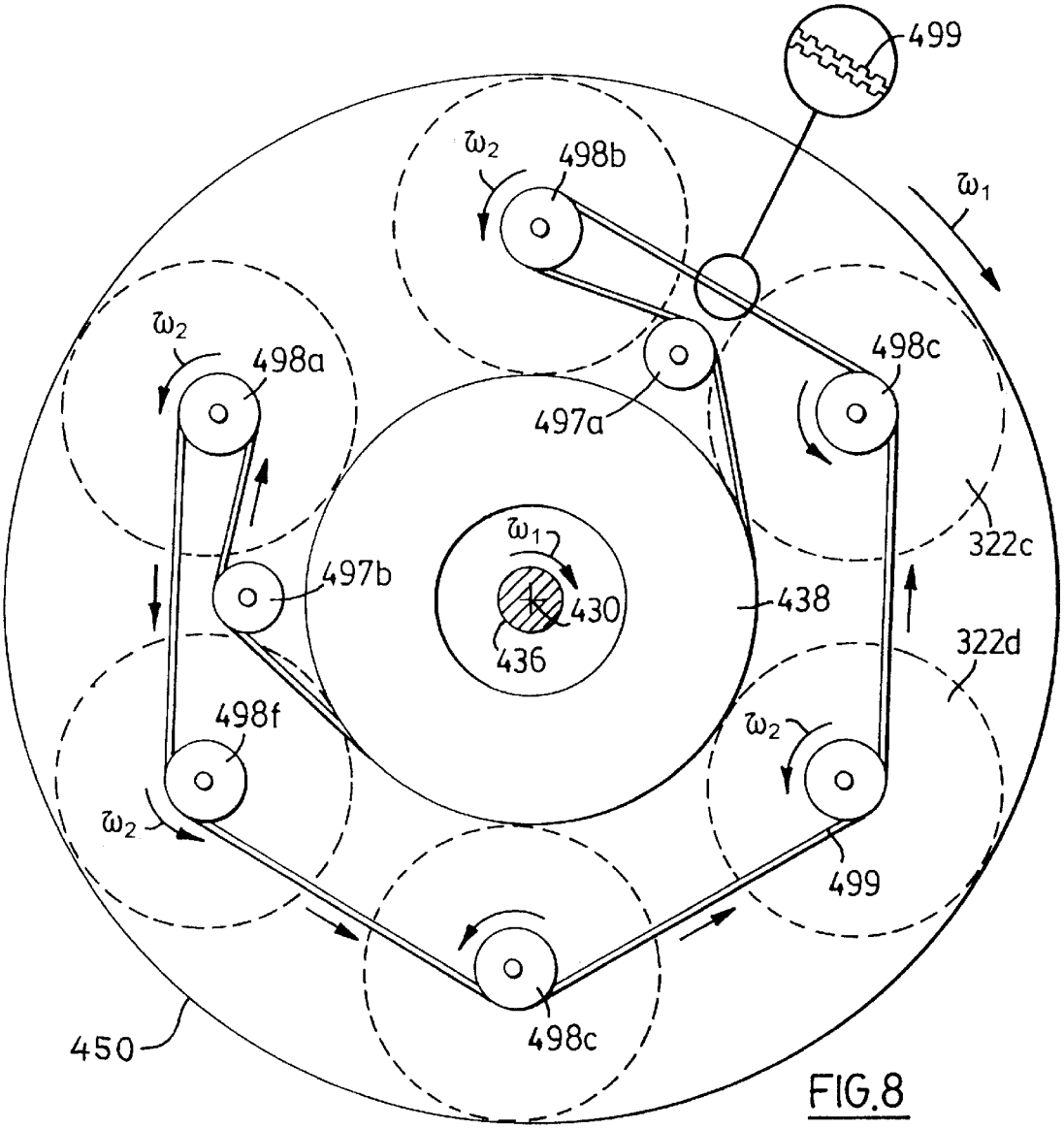
FIG. 8 is a plan view of the rear of the object feeder of FIG. 7.

In FIG. 8 an alternate drive mechanism to the gearing mechanism described above, is shown for the planetary members in a 6 pick-up member rotary system. A sunwheel 438 is fixedly mounted to a support frame (not shown). Sunwheel 438 has mounted along its periphery a number of gear teeth. Disk 450 is mounted to shaft 436, and rotates relative to sunwheel 438. Gears 498 are rotatably mounted on one side of disk 450, and are connected to planetary members 322. Planetary members 322 are mounted on an opposite side of disk 450. A chain 499 mounted about sunwheel 438, gears 498 and idler gears 497. In operation, shaft 436 is driven by a source of rotational power. Disk 450 rotates relative to sunwheel 438. Chain 499 travels along the periphery of sunwheel 438 and engages the gear teeth of sunwheel 438, and thereby moves relative to sunwheel 438. This motion of the chain, thus causes idler gears 497 and gears 498 to rotate. As gears 498 rotate, so do planetary members 322.

Various other types of driving mechanisms for rotary systems within the scope of the present invention are possible.

The Mathematical Assumptions

In each of the above embodiments the tangential velocity of each object-pick up member will be at or approach zero at the vertices of its trajectory. This is achieved through selection of a specific arrangement of mounting distances for planetary axis; moon axis; and pick-up member relative to a sun axis, and relative rates of rotation of carrier; planetary member and moon member. This selection may be even more clearly understood by reference to the following mathematical equations which are valid for the above embodiments:

Where, $E_{uv}/2$=distance from the sun axis 30/330 to the circumferential are created by the pick up point (eg. suction cup) of the pick-up member 26*a* when positioned at the vertices of its trajectory;

D/2=distance from the sun axis 30/330 to the planetary axis 32*a*/332*a;* e=the distance from the planetary axes 32*a*/332*a* to the moon axes 34*a*/334*a;*

Figure 4:
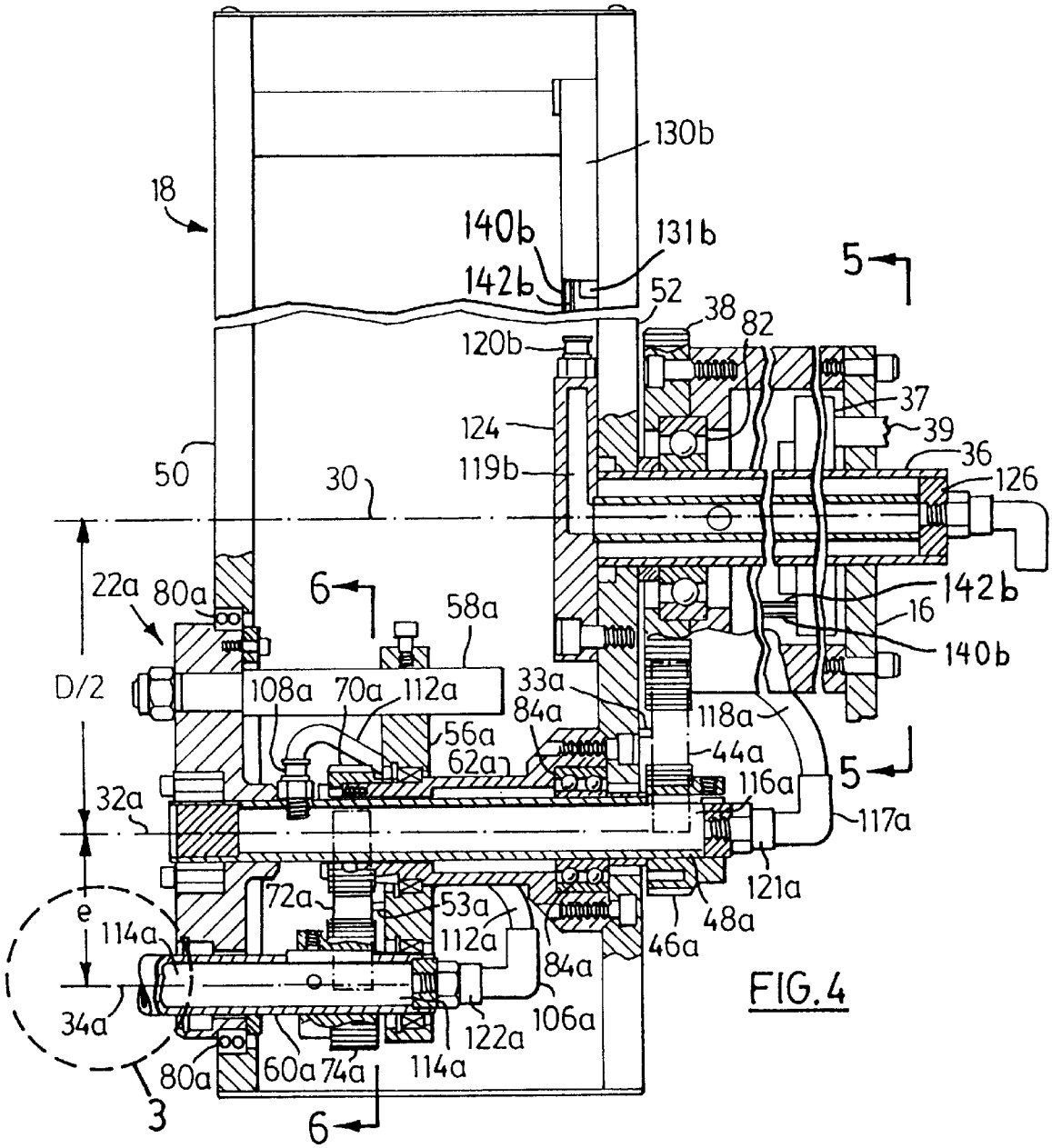
FIG. 4 is a cross sectional view from the side, of part ore object feeder of FIG. 1.

$V_t$=tangential velocity at a vertex of the path of the pick-up member;

The physical significance of these variables is shown is FIGS. 4 and 11*a*.

The tangential velocity of the pick up point of a pick-up member $V_t$ at a vertex of the path is calculated as follows:

$$V_t=(E_{nv}\times\omega_1/2)+\{(E_{uv}-D)\times\omega_2/2)+((E_{nv}-D)/2-e)\times\omega_3\}$$

In order to obtain a minimal tangential velocity of pick-up member 26*a* at these vertices, $E_{nv}$, D, e, $\omega_1$, $\omega_2$ and $\omega_3$ must be chosen such that $V_t$=0 in the above equation.

Thus, in Embodiment 1 (see FIG. 2*a*):

Setting $V_t$=0; and choosing $\omega_2=-3\omega_1$, and $\omega_2=-\omega_3$ yields $$e=E_{uv}/6$$

In Embodiment 4 (see FIG. 11*a*):

Setting $V_t$=0; and choosing $\omega_2=-6\omega_1$, and $\omega_2=-_3$ $$e=E_{nv}/12$$

In both embodiments, D may be calculated by noting:

$$D=E_{nv}-2e$$

It will be understood by a person skilled in the art that many different variations are possible. Depending on the choice of sizes of the carrier and the planetary members, it is possible to construct a rotary feeder with an arbitrary number of carrier members. These carrier members may be adapted to rotate at any rate. By choosing the proper length of mounting shafts and/or extension members it is possible to balance the rotary feeder so that these pick-up members reach a minimum tangential velocity at the vertices of their trajectory(ies).

It will be further understood that the invention is not limited to the illustrations described and shown herein, which are deemed to be merely illustrative of the best modes of carrying out the invention, and which are susceptible to modification of form, size, arrangement of parts and details of operation. The invention, rather, is intended to encompass all such modifications which are within its spirit and scope as defined by the claims.

We claim:

1. A rotary object feeder comprising:

a support;

a carrier rotatably mounted to said support for rotation about a sun axis of rotation;

an object pick-up member mounted to said carrier for rotation therewith about said sun axis and for rotation about a planetary axis of rotation;

said object pick-up member comprising a suction cup, having an outer surface for picking-up and releasing objects proximate a periphery of said feeder;

a vacuum generator having an inlet, and an outlet for generating a source of vacuum at said outlet from a source of pressurized air at said inlet;

said vacuum generator outlet in flow communication with said suction cup;

an electrical control valve fixedly mounted on said carrier in close proximity to said vacuum generator and in flow communication with a source of pressurized air and said vacuum generator inlet, said control valve having an open and closed state, said control valve in said open state providing pressurized air to said vacuum generator inlet;

said object pick-up member coupled to said carrier so that said object pick-up member rotates about said planetary axis relative to said carrier and said electrical control valve as said carrier rotates about said sun axis.

2. The object feeder of claim 1, further comprising a slip ring mounted to said carrier about said sun axis, said slip ring comprising an input and output wire, electrically connected by said ring;

said output wire mounted to said carrier for rotation therewith and electrically connected to said control valve to energize said valve;

said input wire fixed to said support.

3. The object feeder of claim 2, further comprising a controller, electrically connected to said input wire, to energize said control valve to put said valve in said open state.

4. The object feeder of claim 3 further comprising an angular position sensor electrically connected to said controller to provide to said controller a signal indicative of a sensed angular position of said carrier and said pick-up member relative to said sun axis.

5. The object feeder of claim 4 wherein said angular position sensor comprises an electromechanical position sensor.

6. The object feeder of claim 5 wherein said controller calculates speed of rotation of said carrier from said signal corresponding to said angular position.

7. The object feeder of claim 6 wherein said controller is adapted to open said control valve to create suction at said suction cup, when said sensed signal corresponding to said angular position, indicates said suction cup is in proximity to a programmable pick-up location.

8. The object feeder of claim 7 wherein said controller is adapted to close said control valve to release said suction at said suction cup, when said suction cup reaches a turn-off location, said turn-off location calculated by said controller so that said suction cup releases a picked-up object at a pre-programmed drop-off location.

9. The object feeder of claim 1 wherein said vacuum generator and said suction cup are interconnected in flow communication by a hose, said hose having a length of less than ten centimeters.

10. The object feeder of claim 1 further comprising a motor coupled to said carrier member, for rotation of said carrier member and said object pick-up member.

11. A rotary object feeder comprising:

a support;

a carrier member rotatably mounted to said support for rotation about a sun axis of rotation;

a plurality of object pick-up members, each comprising an associated suction cup, having an outer surface for picking-up and releasing objects proximate a periphery of said feeder, mounted to said carrier member, for rotation herewith;

a plurality of control valves, each in flow communication with an associated suction cup, each of said control valves having an open and closed state, said control valves to provide suction at an outer surface of an associated suction cup when in said open state;

a controller, in communication with each of said control valves to open and close each of said control valves to provide suction at an outer surface of an associated suction cup;

an angular position sensor on said feeder, in communication with said controller to provide a signal used by said controller to determine a measurement of an angular position of said carrier member about said sun axis;

wherein said controller opens and closes each of said control valves to provide suction at said associated outer surfaces in response to determined angular positions of said carrier member corresponding to pre-programmed angular positions of said carrier member about said sun axis.

12. The object feeder of claim 11 wherein said control valves are mounted to said carrier member for rotation therewith.

13. The object feeder of claim 12, further comprising a slip ring mounted to said carrier member about said sun axis, said slip ring comprising a plurality of input wires each having an associated output wire, electrically connected by said ring, said output wires mounted to said carrier member for rotation therewith and electrically connected to said control valves to energize said valves;

said input wires affixed to said support.

14. The object feeder of claim 13 further comprising a plurality of vacuum generators, each having an inlet and an outlet, each said inlet in flow communication with an associated control valve, each said outlet in flow communication with an associated suction cup.

15. The object feeder of claim 14 wherein said vacuum generators are mounted on said pick-up member, proximate an associated suction cup.

16. The object feeder of claim 15 wherein said position sensor is an electromechanical position sensor.

17. The object feeder of claim 16 wherein said controller calculates speed of rotation of said carrier member from said signal corresponding to said angular position.

18. The object feeder of claim 11, wherein said controller is adapted to open at least one of said control valves to create suction at an associated suction cup, when said sensed signal corresponding to said angular position indicates said associated suction cup is in proximity to a pre-programed object pick-up location.

19. The object feeder of claim 18, wherein said controller is adapted to close and releases said at least one control valve when said sensed signal corresponding to said angular position indicates said suction cup has reached a turn-off location.

20. The object feeder of claim 19, wherein said controller calculates said turn-off location so that said suction cup releases a picked-up object to a defined drop-off location.

21. The object feeder of claim 20, wherein said turn-off location is calculated based on a speed of rotation of said carrier member.

22. The object feeder of claim 11, wherein said controller is adapted to open and close said control valves to create suction at associated suction cups, in response to sensed, pre-programmed angular positions of said object pick-up members.

23. A method of feeding an object from a pick-up location to a drop-off location, on the periphery of a rotary object feeder, using said rotary object feeder comprising:

a support;

a carrier member rotatably mounted to said support for rotation about a sun axis of rotation;

an object pick-up member mounted to said support, for rotation therewith;

said object pick-up member comprising a suction cup, having an outer surface that passes proximate said pick-up and drop-off location as said carrier member is rotated about said sun axis, said suction cup for picking-up and releasing objects proximate said pick-up and drop-off locations;

said method comprising the steps of:

a. continuously rotating said carrier member and said pick-up member about said sun axis;

b. continuously sensing an angular position of said carrier and said pick-up member relative to said support;

c. continuously determining the angular rate of rotation of said carrier;

d. applying a vacuum at said suction cup before said suction cup reaches proximate said pick-up location to pick up an object at said pick-up location;

e. determining a vacuum turn-off point, in advance of said drop-off location, based on said angular rate-of rotation, said turn-off point calculated so that said picked-up object, retained by said vacuum at said suction cup is released at said drop-off location in response to turning-off said vacuum at said vacuum turn-off point;

f. turning off said vacuum at said suction cup as said suction cup reaches said turnoff point.

24. The method of claim 23 wherein step e. further comprises the step of determining said turn-off point based on a measurement of time required to release a vacuum at said suction cup.

25. A rotary object feeder comprising:

a support;

a carrier member rotatably mounted to said support for rotation about a predetermined axis of rotation;

a plurality of object pick-up members mounted to said carrier at angular spaced positions about said predetermined axis;

each object pick-up member comprising a suction cup, having an outer surface for picking-up and releasing objects proximate a periphery of said feeder;

a vacuum generator having an inlet and an outlet for generating a source of vacuum at said outlet from a source pressurized gas at said inlet;

said vacuum generator outlet in flow communication with said suction cup;

a plurality of independently controllable electrical control valves mounted on said carrier, each mounted in close proximity to an associated one of said vacuum generators, each of said control valves in flow communication with a source of pressurized gas and an inlet of an associated one of said vacuum generators, each said control valve having an open and closed state, each said control valve in said open state providing pressurized air to an associated vacuum generator inlet;

a slip ring mounted to said carrier about said sun axis;

said slip ring comprising a plurality of input and output wires, each input wire electrically interconnected with an associated output wire;

each of said plurality of output wires mounted to said carrier for rotation therewith and electrically connected to one of said control valves;

said plurality of input wires fixed to said support;

a controller, electrically connected to said plurality of input wires, to selectively energize said control valves to provide pressurized air to said vacuum generators as said carrier member rotates about said sun axis.

26. A rotary feeder comprising:

a support;

a carrier member rotatably mounted to said support for rotation about a predetermined axis of rotation;

a plurality of object pick-up members mounted to said carrier member at angularly spaced positions about said predetermined axis;

each object pick-up member comprising;

a suction cup, having an outer surface for picking up and releasing objects proximate a periphery of said feeder;

a vacuum generator having an inlet and an outlet for generating a source of vacuum at said outlet from a supply pressurized gas at said inlet;

said vacuum generator being in flow communication with said suction cup;

a plurality of electrically controlled valve means, each mounted in close proximity to an associated vacuum generator, for connecting a source of pressurised gas to inlets of each of the vacuum generators during part of each resolution thereof about said predetermined axis;

a programmable controller, in communication with each of said valve means to independently open and close each of said valve means to provide suction at an outer surface of an associated suction cup.

27. The rotary feeder of claim 26, further comprising an angular position sensor on said feeder, in communication with said programmable controller to provide a signal used by said programmable controller to determine a measurement of an angular position of said carrier member about said sun axis.

28. The rotary feeder of claim 27, wherein said programmable controller is adapted to open and close each of said valve means to provide suction at said associated outer surfaces in response to determined angular positions of said carrier member corresponding to pre-programmed angular positions of said carrier member about said sun axis.

29. The rotary feeder of claim 28, wherein said controller is adapted to close and release at least one valve means when said sensed signal corresponding to said angular position indicates a suction cup associated with said at least one valve means has reached a turn-off location.

30. The rotary feeder of claim 29, wherein said controller calculates said turn-off location so that said suction cup associated with said at least one valve means releases a picked-up object to a defined drop-off location.

31. The rotary feeder of claim 30, wherein said turn-off location is calculated based on a speed of rotation of said carrier member.

* * * * *